US008042387B2

(12) United States Patent
Zazovsky et al.

(10) Patent No.: US 8,042,387 B2
(45) Date of Patent: Oct. 25, 2011

(54) METHODS AND APPARATUS TO CONTROL A FORMATION TESTING OPERATION BASED ON A MUDCAKE LEAKAGE

(75) Inventors: Alexander Zazovsky, Houston, TX (US); Fernando Garcia-Osuna, Sugar Land, TX (US); Steve G. Villareal, Houston, TX (US); Timur Zharnikov, Reutov (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 730 days.

(21) Appl. No.: 12/122,077

(22) Filed: May 16, 2008

(65) Prior Publication Data

US 2009/0282907 A1 Nov. 19, 2009

(51) Int. Cl.
*E21B 49/10* (2006.01)

(52) U.S. Cl. ..... 73/152.24

(58) Field of Classification Search ..... 73/152.24, 73/152.26–152.28, 152.51; 702/6, 11
See application file for complete search history.

(56) References Cited

U.S. PATENT DOCUMENTS

| | | | | |
|---|---|---|---|---|
| 5,233,866 | A | 8/1993 | Desbrandes | |
| 5,602,334 | A | 2/1997 | Proett et al. | |
| 5,644,076 | A | 7/1997 | Proett et al. | |
| 5,703,286 | A | 12/1997 | Proett et al. | |
| 6,301,959 | B1 | 10/2001 | Hrametz et al. | |
| 6,769,296 | B2 | 8/2004 | Montalvo et al. | |
| 6,832,515 | B2 | 12/2004 | Follini et al. | |
| 7,031,841 | B2 | 4/2006 | Zazovsky et al. | |
| 7,234,521 | B2 | 6/2007 | Shammai et al. | |
| 7,243,537 | B2 * | 7/2007 | Proett et al. | 73/152.51 |
| 7,331,223 | B2 * | 2/2008 | Zazovsky | 73/152.51 |
| 7,558,716 | B2 * | 7/2009 | Hammond | 703/10 |
| 2005/0171699 | A1 * | 8/2005 | Zazovsky et al. | 702/11 |
| 2005/0235745 | A1 * | 10/2005 | Proett et al. | 73/152.22 |
| 2006/0129365 | A1 * | 6/2006 | Hammond | 703/10 |
| 2009/0165548 | A1 * | 7/2009 | Pop et al. | 73/152.51 |

OTHER PUBLICATIONS

Proett, et al., "Formation Pressure Testing in the Dynamic Drilling Environment," IADC/SPE 87090, pp. 1-11, IADC/SPE Drilling Conference, Dallas, TX (Mar. 2-4 2004).

Pop et al., "Operational Aspects of Formation Pressure Measurements while Drilling," SPE/IADC 92494, pp. 1-16, SPE/IADC Drilling Conference, Amsterdam, The Netherlands (Feb. 23-25 2005).

Akram et al., "A Model to Predict Wireline Formation Tester Sample Contamination," SPE 48958, pp. 27-33, SPE Annual Technical Conference & Exh., New Orleans, LA (Sep. 27-30 1996).

* cited by examiner

*Primary Examiner* — John Fitzgerald
(74) *Attorney, Agent, or Firm* — David Hofman

(57) ABSTRACT

Methods and apparatus to control a formation testing operation based on a mudcake leakage are disclosed. A disclosed example method for use with a downhole tool disposed in a wellbore comprises measuring a property of a mudcake layer at a first location in a wellbore, determining a value representative of an estimated leakage through the mudcake layer based on the property, and determining, based on the value, whether to continue a formation testing operation.

22 Claims, 16 Drawing Sheets

| PROBE TYPE | PROBE DIAMETER (inches) | INLET AREA (square inches) | RELATIVE INLET AREA | FLOW SHAPE FACTOR |
|---|---|---|---|---|
| STANDARD PROBE (SP) | 0.437 | 0.15 | 1 | 5660 |
| LARGE DIAMETER PROBE (LDP) | 1.04 | 0.85 | 5.5 | 2395 |
| EXTRA LARGE DIAMETER PROBE (XLDP) | 1.66 | 2.16 | 14 | 1556 |
| LARGE AREA PACKER (LAP) | 2.25 | 3.97 | 25.6 | 1107 |
| ELLIPTICAL PACKER (eProbe) | - | 11.3 | 73 | 656 |

METHODS AND APPARATUS TO CONTROL A FORMATION TESTING OPERATION BASED ON A MUDCAKE LEAKAGE

FIELD OF THE DISCLOSURE

This disclosure relates generally to formation testing in a wellbore and, more particularly, to methods and apparatus to control a formation fluid sampling operation based on a mudcake leakage.

BACKGROUND

A mudcake layer is created during drilling operations by a drilling fluid that is conveyed downhole through a drill string and expelled through ports in a drill bit to lubricate the drill bit during the drilling operations and to carry formation cuttings to the surface. The mudcake layer is formed as the drilling fluid mixes with the formation cuttings and/or other solids, and circulates upwardly through an annular region between the outer surface of the drill string and a borehole wall. This mixture coats the borehole wall to create the mudcake layer. One function of the mudcake layer is to hydraulically isolate a formation from the interior of a borehole. A mudcake layer is often referred to in the industry as a mudcake or filter cake.

SUMMARY

Methods and apparatus to control a formation testing operation based on a mudcake leakage are disclosed. A disclosed example method, for use with a downhole tool disposed in a wellbore, includes measuring a downhole property at a first location, the wellbore having a mudcake layer formed on a wall thereof, determining a value representative of an estimated leakage through the mudcake layer based on the property, and determining, based on the value, whether to initiate a formation testing operation.

Another disclosed example method, for use with a downhole tool disposed in a wellbore, includes initiating a formation testing operation, measuring a downhole property at a first location, the wellbore having a mudcake layer formed on a wall thereof, determining a value representative of an estimated leakage through the mudcake layer based on the property; and determining, based on the value, whether to terminate the formation testing operation.

A disclosed example apparatus, for use with a downhole tool, includes a sensor to measure a property of a mudcake layer in a wellbore, a processor to determine, based on the property, a value representative of an estimated leakage through the mudcake layer; and sampling decision logic to determine, based on the value, whether to continue a formation testing operation.

DETAILED DESCRIPTION

Figure 1:
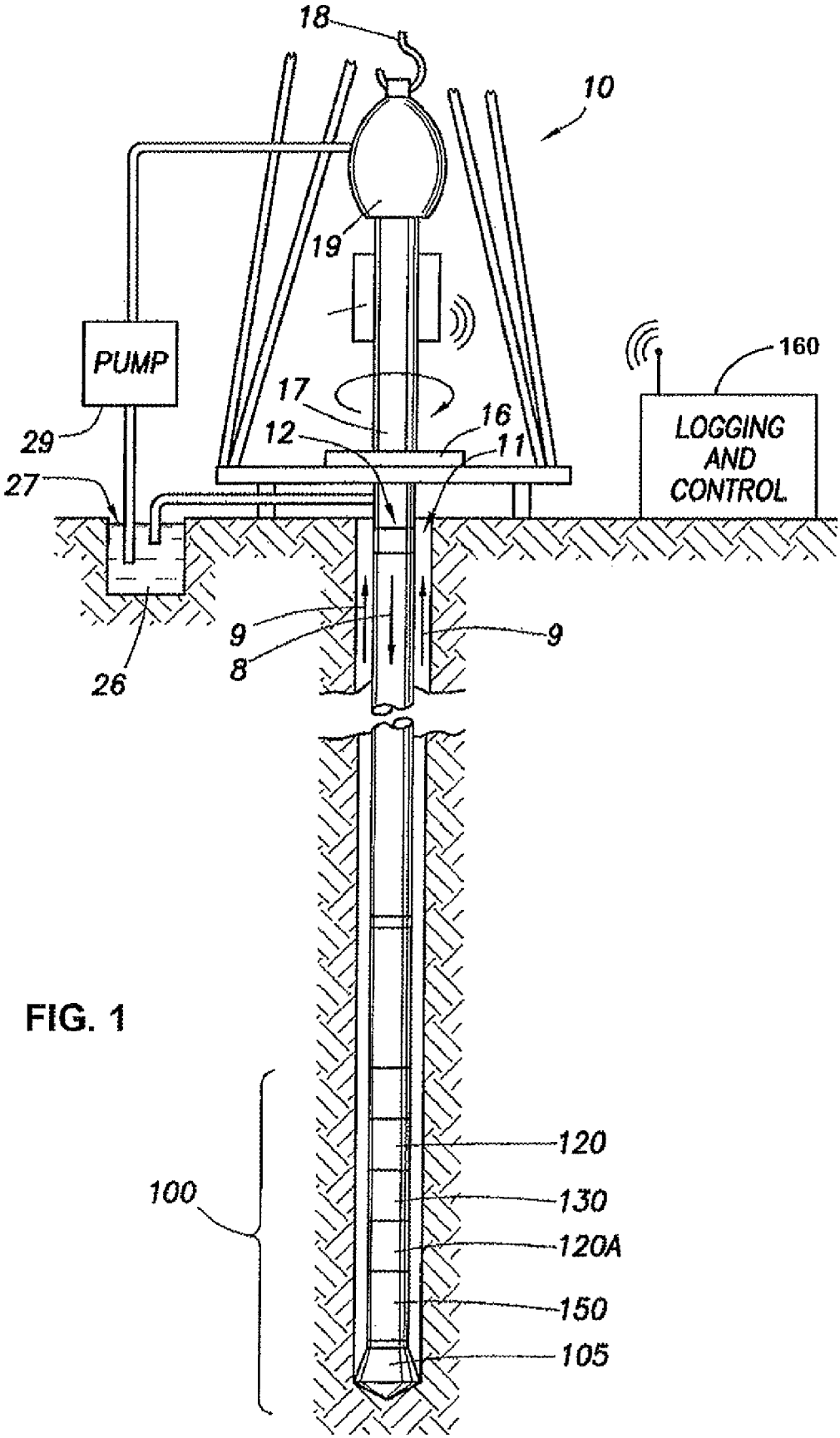
FIG. 1 illustrates an example wellsite drilling system.

The quality of a mudcake layer is often deterministic of the ability to successfully perform a cleanup operation in order to recover an acceptably and/or substantially pristine formation fluid sample having acceptable and/or low levels of contaminants from a mud filtrate. While performing measurement-while-drilling (MWD) operations and/or logging-while-drilling (LWD) operations, the mudcake layer can be thinner (e.g., due to damage by a portion of a drill string and/or a relatively shorter time between a drilling operation and a sampling operation), and the formation may be exposed to a pressure overbalance for a relatively shorter duration, as compared to sampling performed with a wireline tool. In general, the quality of the mudcake layer (e.g. the amount of mud filtrate leakage that occurs through the mudcake layer) and the pumpout rate of a sampling tool determine the quality of a resultant formation fluid sample. For example the more leakage through the mudcake layer the greater the amount of fluid that must be pumped out before a fluid sample with a desired amount of filtrate contamination can be obtained. If the amount leakage through a mudcake layer is sufficiently low, it is relatively easy to pumpout a sufficient volume of fluid to reduce the amount of contamination due to mud filtrate contained in a formation fluid sample to an acceptable level (possibly zero). In contrast, an overly thin mudcake layer (e.g., one that allows a substantial amount of filtrate leakage through the mudcake) can lead to hydraulic shorting. Such hydraulic shorting causes substantially greater quantities of drilling fluid and/or mud filtrate to leak through the mudcake layer during a fluid sample drawing operation, contaminating virtually all fluid samples drawn by a sampling tool, regardless of the volume of fluid pumped out of the formation by the sampling tool.

The example methods and apparatus described herein can be used to estimate how much filtrate leakage may occur through a mudcake layer to determine whether it is expected that formation fluid samples having tolerable or acceptable contamination levels can be successfully extracted from a formation at a particular location of a borehole. Such determinations may be used to determine whether to initiate a sampling operation (e.g., to begin a pumpout process leading to a formation fluid sample being captured or obtained), and/or to determine whether to continue the pumpout process.

In particular, the example methods and apparatus described herein can be used to distinguish between a) when mudcake layer quality is insufficient to allow capturing of a formation fluid sample having an acceptable contamination level and b) when mudcake layer quality is sufficient to allow capturing of an acceptable formation fluid sample. In this manner, when it is determined that mudcake quality is insufficient or too poor to allow acceptable testing, drilling time can be used more efficiently by continuing with drilling operations instead of stopping to perform testing as would otherwise occur. While the example methods and apparatus disclosed herein are described with reference to collecting of formation fluid samples, the example methods and apparatus may, additionally or alternatively, be used to estimate a property representative of the purity of a formation fluid. For instance, an example sampling operation could draw a sufficient amount of formation fluid to estimate the purity of a formation fluid without collecting an actual formation sample.

While example methods and apparatus are described herein with reference to so-called "sampling-while-drilling," "logging-while-drilling," and/or "measuring-while drilling" operations, the example methods and apparatus may, additionally or alternatively, be used to determine whether to attempt to collect a formation fluid sample during a wireline sampling operation. Moreover, such while-drilling operations do not require that sampling, logging and/or measuring actually occur while drilling is actively taking place. For example, as commonly performed in the industry, a drill bit of a drill string drills for a period of time, drilling is paused, one or more formation measurements and/or formation fluid samples are taken by one or more sampling, measuring and/or logging devices of the drill string, and then drilling is resumed. Such activities are referred to as sampling, measuring and/or logging while drilling operations because they do not require the removal of a drill string from the borehole in order to perform formation measurements and/or to obtain formation fluid samples.

Certain examples are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness.

FIG. 1 illustrates an example prior art wellsite drilling system that can be employed onshore and/or offshore. In the example wellsite system of FIG. 1, a borehole 11 is formed in one or more subsurface formations by rotary and/or directional drilling.

As illustrated in FIG. 1, a drill string 12 is suspended within the borehole 11 and has a bottom hole assembly (BHA) 100 having a drill bit 105 at its lower end. A surface system includes a platform and derrick assembly 10 positioned over the borehole 11, the assembly 10 includes a rotary table 16, a kelly 17, a hook 18 and a rotary swivel 19. The drill string 12 is rotated by the rotary table 16, energized by means not shown, which engages the kelly 17 at the upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally or alternatively, a top drive system could be used.

In the example of FIG. 1, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid 26 exits the drill string 12 via ports in the drill bit 105, and then circulates upwardly through the annulus region between the outside of the drill string and the wall of the borehole, as indicated by the directional arrows 9. The drilling fluid 26 lubricates the drill bit 105, carries formation cuttings up to the surface as it is returned to the pit 27 for recirculation, and creates a mudcake layer on the walls of the borehole 11.

The example BHA 100 of FIG. 1 includes, among other things, any number and/or type(s) of logging-while-drilling (LWD) modules (two of which are designated at reference numerals 120 and 120A) and/or measuring-while-drilling (MWD) modules (one of which is designated at reference numeral 130), a roto-steerable system and motor, and the example drill bit 105.

The example LWD modules 120 and 120A of FIG. 1 are each housed in a special type of drill collar, as it is known in the art, and each contain any number of logging tools and/or testing devices. The example LWD modules 120, 120A include capabilities for measuring, processing, and/or storing information, as well as for communicating with surface equipment, such as a logging and control computer 160 via, for example, the MWD module 130.

An example manner of implementing a sampling control module for a LWD module 120, 120A, which makes formation testing decisions based on a mudcake quality (e.g., an estimated amount of leakage through a mudcake layer), is described below in connection with FIG. 9. Additionally or alternatively, all or a portion of the example sampling control module of FIG. 8 may be implemented by the example logging and control computer 160. For example, measurements may be taken by one or more LWD modules 120, 120A and conveyed via, for example, telemetry to the logging and control computer 160, which makes testing decisions based on the measurements performed by the LWD module(s) 120, 120A. Moreover, two or more LWD modules 120, 120A may interact to make testing decisions. For instance, the example LWD module 200 of FIG. 2 may be used to obtain wellbore and sandface pressure measurements that are used by a sampling control module 330 of the example LWD module 300 of FIG. 3 to make testing decisions.

Other example manners of implementing a LWD module 120, 120A are described in U.S. Pat. No. 7,114,562, entitled "Apparatus and Method For Acquiring Information While Drilling," and issued on Oct. 3, 2006; and in U.S. Pat. No. 6,986,282, entitled "Method and Apparatus For Determining Downhole Pressures During a Drilling Operation," and issued on Jan. 17, 2006. U.S. Pat. No. 7,114,562, and U.S. Pat. No. 6,986,282 are hereby incorporated by reference in their entireties.

The example MWD module 130 of FIG. 1 is also housed in a special type of drill collar and contains one or more devices for measuring characteristics of the drill string 120 and/or the drill bit 105. The example MWD tool 130 further includes an apparatus (not shown) for generating electrical power for use by the downhole system. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick slip measuring device, a direction measuring device, and an inclination measuring device.

Figure 2:
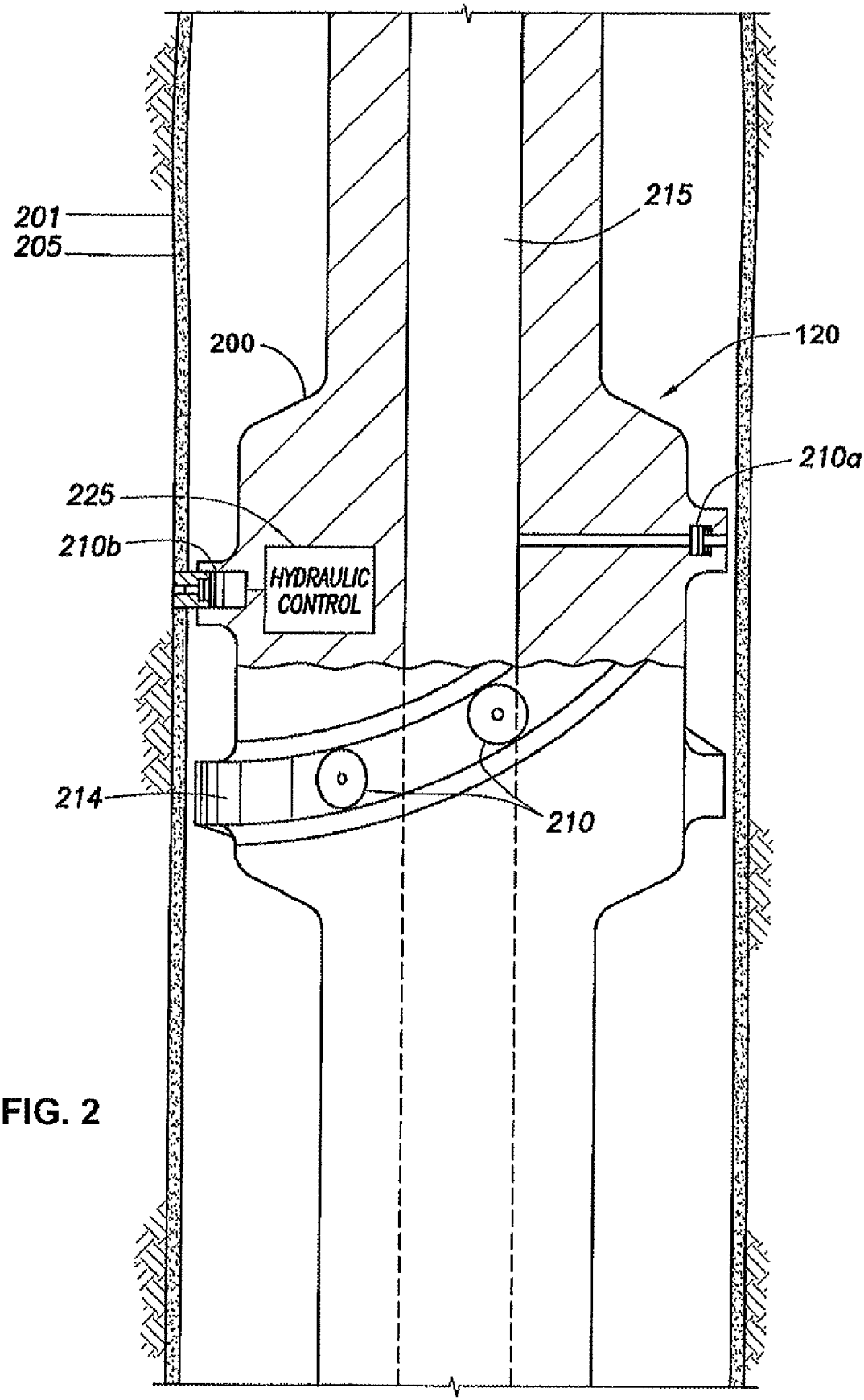
FIGS. 2 and 3 illustrate example manners of implementing either or both of the example logging while drilling (LWD) modules of FIG. 1.

FIG. 2 is a schematic illustration of an example manner of implementing either or both of the example LWD modules 120 and 120A of FIG. 1. While either of the example LWD modules 120 and 120A of FIG. 1 may be implemented by the example device of FIG. 2, for ease of discussion, the example device of FIG. 2 will be referred to as LWD module 120. The example LWD module 120 of FIG. 2 may be used to take wellbore pressures and sand face pressures, which may be used by, for example, the example sampling control module 800 of FIG. 8, a sampling control module of another LWD module 120, 120A (e.g., the example sampling control module 330 of FIG. 3), and/or the example surface computer 160 to make testing decisions.

The example LWD module 120 of FIG. 2 is of a type disclosed in U.S. Pat. No. 6,986,282, which is incorporated herein by reference in its entirety, for determining downhole pressures including annular pressure, formation pressure, and pore pressure during a drilling operation. The example LWD module 120 is formed in a modified stabilizer collar or drill collar 200, which has a passage 215 extending therethrough for drilling fluid. The flow of fluid through the module 120 creates an internal pressure PI. The exterior of the drill collar 200 is exposed to the wellbore and/or annular pressure PA of the surrounding wellbore. The differential pressure δP between the internal pressure PI and the annular pressure PA is used to activate pressure assemblies 210. Two representative pressure measuring assemblies are shown at 210*a* and 210*b*, which are mounted on respective stabilizer blades. The example pressure assembly 210*a* is used to monitor annular pressure PA in the borehole, and/or pressures of the surrounding formation when positioned in engagement with a borehole wall or surface 201. In FIG. 2, the pressure assembly 210*a* is not engaged with the borehole wall 201 and, therefore, may measure annular pressure PA, if desired. When moved into engagement with the borehole wall 201, the pressure assembly 210*a* may be used to measure a sandface and/or pore pressure of the surrounding formation. As also seen in FIG. 2, the pressure assembly 210*b* is extendable from a stabilizer blade 214, using a hydraulic control 225, for sealing engagement with a mudcake layer 205 and/or the wall 201 of the borehole for taking measurements of the surrounding formation. The above referenced U.S. Pat. No. 6,986,282 can be referred to for further details. Circuitry (not shown in this view) couples pressure-representative signals to a processor/controller, an output of which is coupleable to telemetry circuitry, to other LWD modules 120, 120A, and/or to the example sampling control module 800 of FIG. 8. Additionally or alternatively, the example pressure 1510 sensor of FIG. 15 may be used to measure wellbore and/or sandface pressures.

Figure 3:
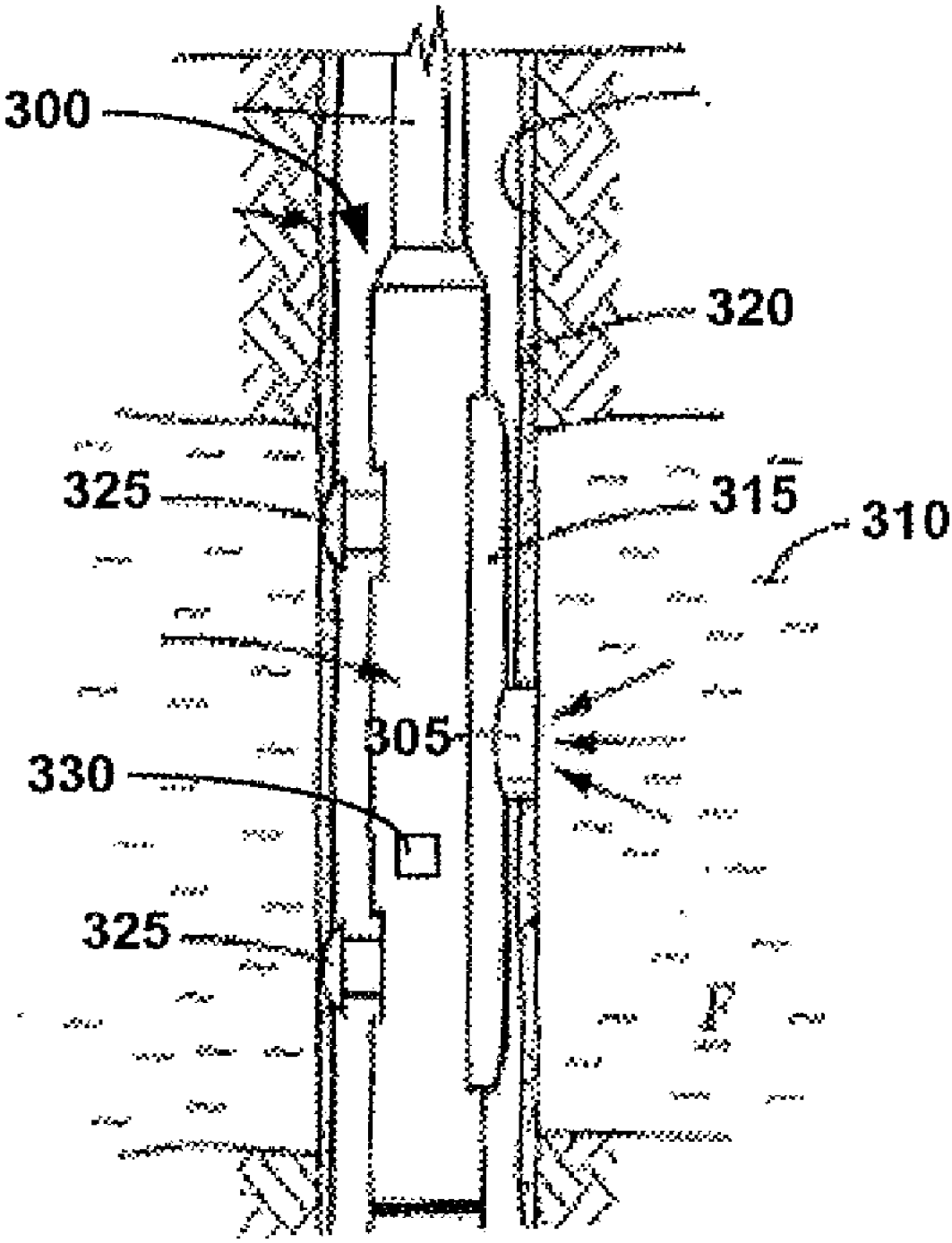

FIG. 3 is a schematic illustration of an example manner of implementing either or both of the example LWD modules 120 and 120A of FIG. 1. While either of the example LWD modules 120 and 120A of FIG. 1 may be implemented by the example device of FIG. 3, for ease of discussion, the example device of FIG. 3 will be referred to as LWD module 300. The example LWD module 300 of FIG. 3 may be used to obtain one or more measurements of a mudcake, which may be used by, for example, the example sampling control module 800 of FIG. 8, a sampling control module of another LWD module 120, 120A, and/or the example surface computer 160 to make testing decisions. Additionally or alternatively, the example LWD module 300 may be used to obtain samples of formation fluids.

The example LWD tool 300 of FIG. 3 is provided with a probe 305 for establishing fluid communication with a formation F and to draw a fluid 310 into the tool 300, as indicated by the arrows. The example probe 305 may be positioned, for example, within a stabilizer blade 315 of the LWD tool 300 and extended from the stabilizer blade 315 to engage a borehole wall 320. An example stabilizer blade 315 comprises one or more blades that are in contact with the borehole wall 320. Fluid 310 drawn into the LWD tool 300 using the probe 305 may be measured to determine, for example, pretest and/or pressure parameters. Additionally, the LWD tool 300 may be provided with devices, such as sample chambers (not shown), for collecting fluid samples for retrieval at the surface. Backup pistons 325 may also be provided to assist in applying force to push the sampling tool 300 and/or the probe 305 against the borehole wall 320. Further, the example LWD tool 300 may be provided with one or more additional devices described below in connection with FIG. 8 to measure one or more properties of a mudcake layer.

To determine whether to initiate a formation testing operation and/or a pumpout operation, the example LWD module 300 of FIG. 3 includes a sampling control module 330. As described below in connection with FIG. 8, the example sampling control module 330 includes one more measurement devices (e.g., sensors) to measure one or more properties of a mudcake layer, and sampling decision logic to determine whether to initiate and/or continue a formation testing operation based on measurements taken by the measurement devices. An example manner of implementing the example sampling control module 330 of FIG. 3 is described below in connection with FIG. 8.

Figure 4:
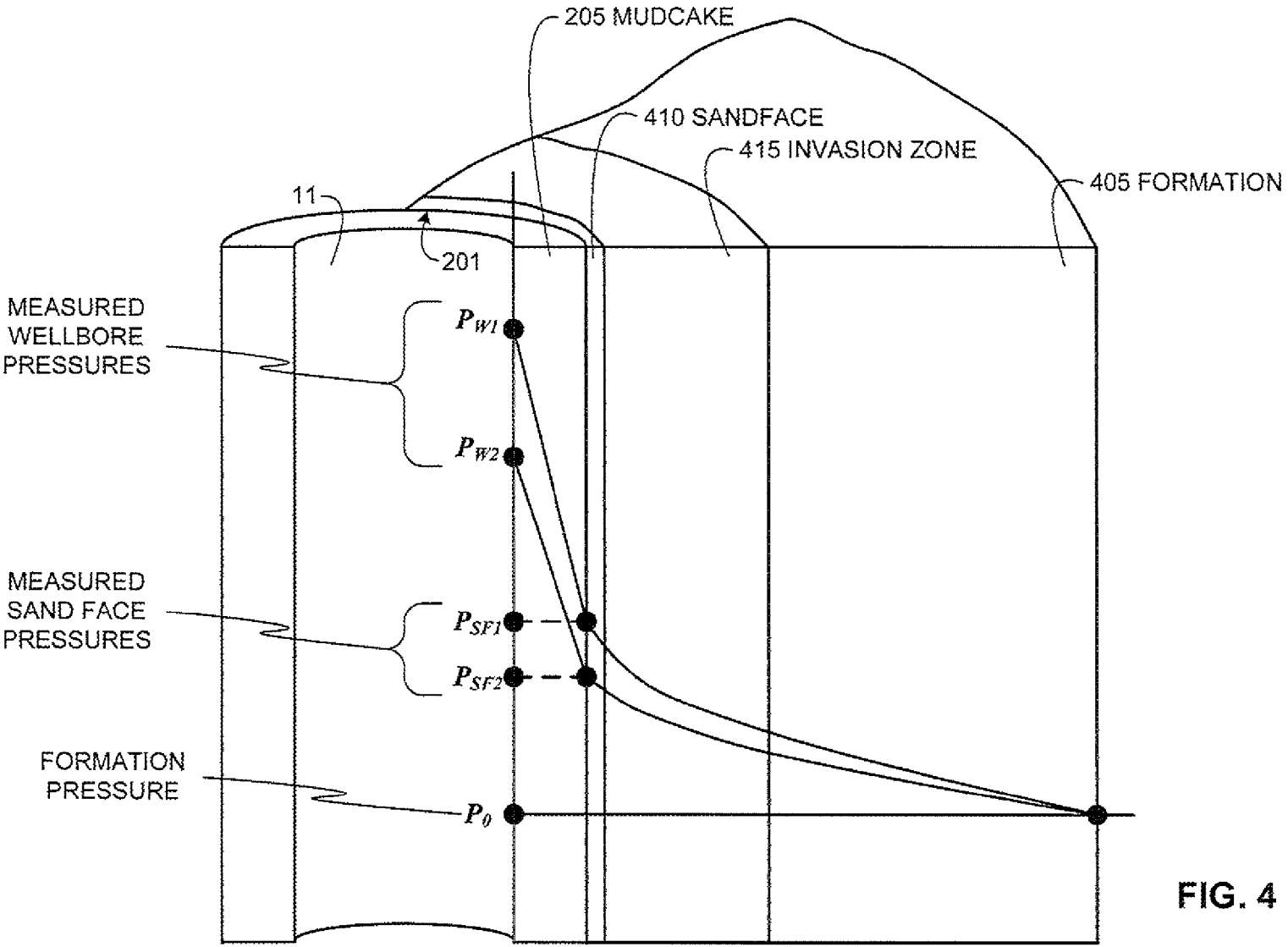
FIG. 4 is an illustration of a portion of an example borehole.

FIG. 4 depicts a portion of the example borehole 11 of FIG. 1 shown in connection with structural features of a subsurface formation 405 during a drilling operation. As shown, the mudcake layer 205 is formed on the borehole wall 201 against a sand face 410. In addition, the mud filtrate that forms the mudcake layer 205 invades the formation 405 through the sand face 410 to create an invasion zone 415 of the mud filtrate (e.g., a contaminant).

Figure 5:
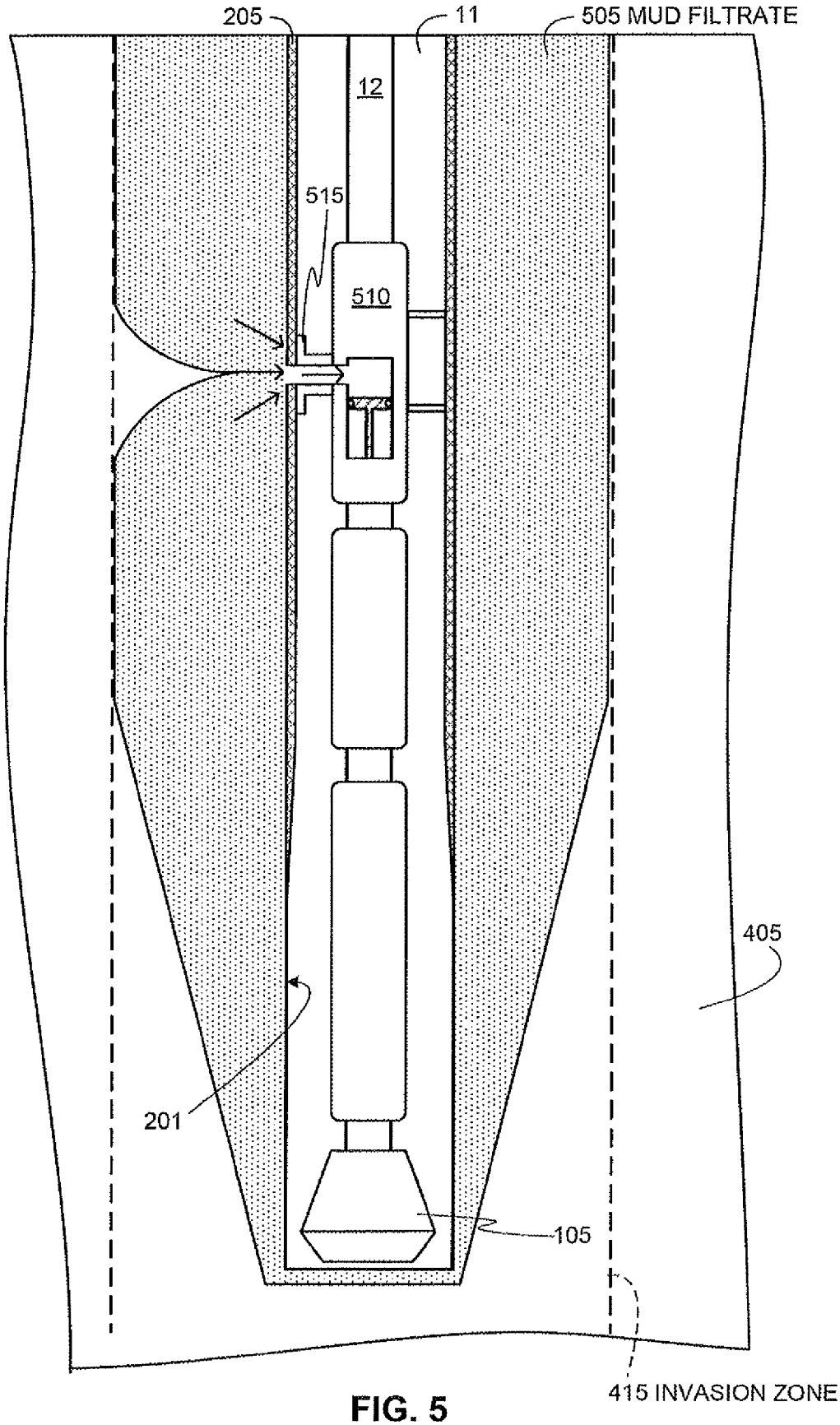
FIG. 5 illustrates an example invasion zone formed by mud filtrate that has permeated a formation.

Turning briefly to FIG. 5, the invasion zone 415 is formed when the drill bit 105 initially drills and/or crushes through the formation 405 to form the borehole 11 at which point the mudcake layer 205 is not yet formed and mud filtrate 505 is able to permeate into the formation 405 via the borehole 11 for a distance that defines the extent of the invasion zone 415 into the formation 405. After the drill bit 105 proceeds past a particular portion of the borehole 11, the mud filtrate 505 begins to build the mudcake layer 205, as shown in FIG. 5, as the filtrate is mixed with formation cuttings and is circulated upward through the annulus region between an outer surface of the drill string 12 and the borehole wall 201.

During a pumpout phase when a sampling tool 510 is used to draw formation fluid samples from the formation 405 via a probe 515, the fluid drawn during an initial portion of the pumpout phase contain contamination from the mud filtrate 505 in the invasion zone 415. Over time, as the pumpout operations continue, the drawn fluid may eventually deplete a substantial portion of the mud filtrate in a local portion of the formation 405 so that the mud filtrate contaminant 505 in the subsequently drawn fluid samples is progressively reduced.

Figure 6:
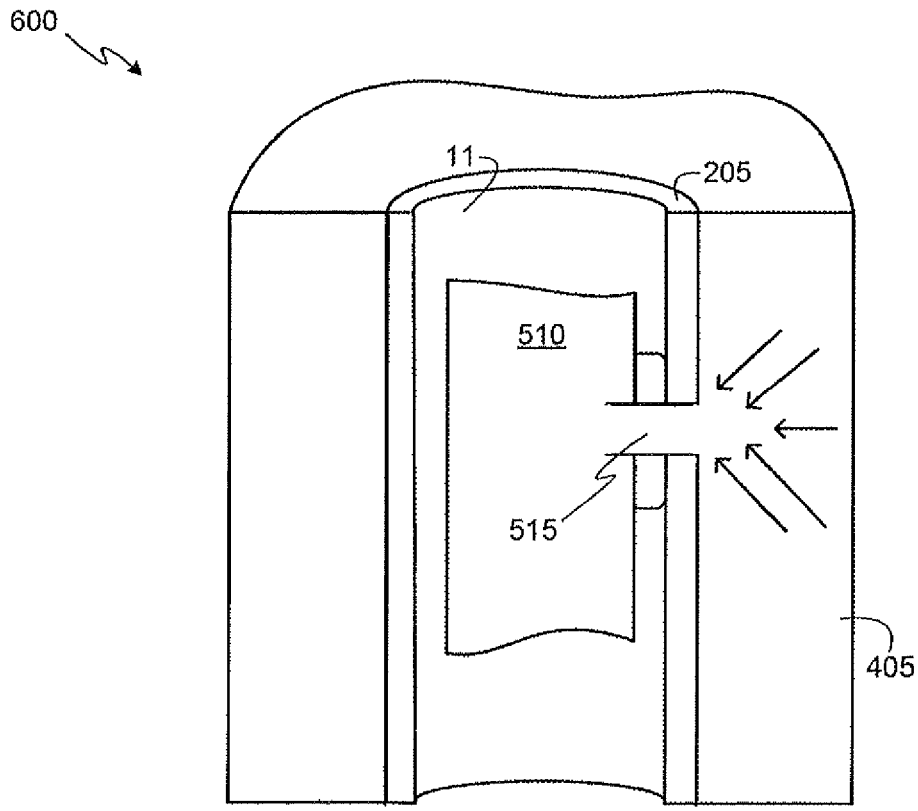
FIGS. 6 and 7 illustrate example fluid flows resulting from a pumpout phase of a testing operation.

Turning briefly to FIG. 6, at a borehole portion 600 of the example borehole 11 of FIGS. 1-5, the mudcake layer 205 is substantially competent and/or has sufficient quality to resist mud filtrate leakage from the borehole into the formation 405 during a fluid pumpout operation. As shown, fluid drawn by the sampling tool 510 via the probe 515 is drawn from the formation 405 while the mudcake layer 205 substantially prevents mud filtrate from leaking into the formation 405 from the borehole 11. In this manner, mud filtrate contaminant in fluid samples drawn during an initial portion of a pumpout phase is limited to the contamination in the invasion zone 415 (FIGS. 4 and 5), and over time the amount of mud filtrate contaminant in the drawn fluid samples is reduced because the mudcake layer 205 prevents replenishment of the mud filtrate 505 in the invasion zone 415.

Figure 7:
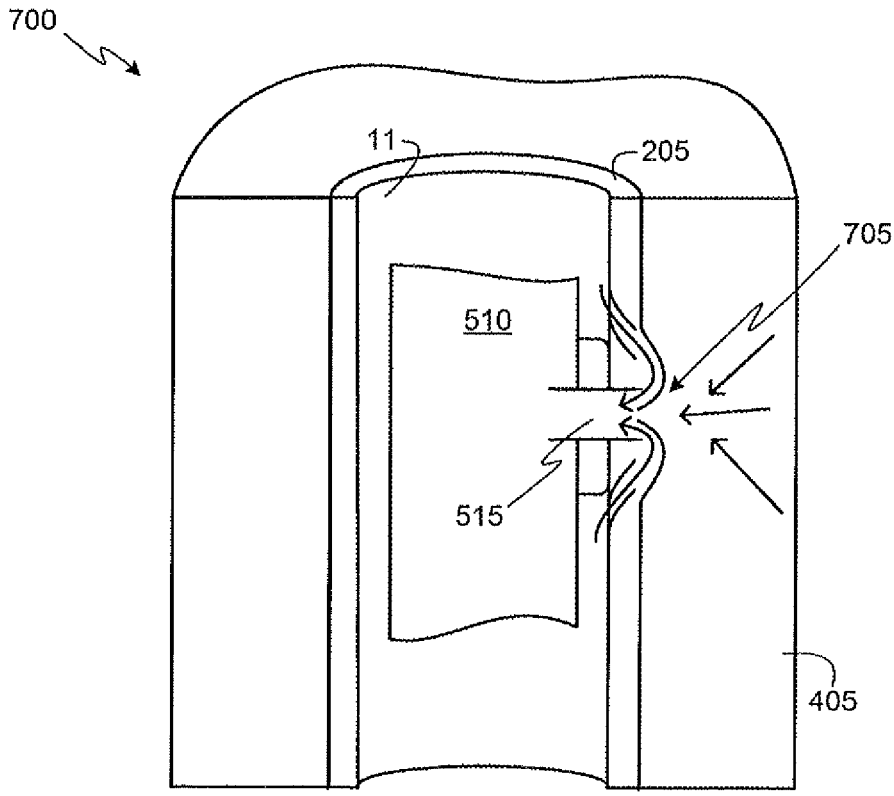

Turning briefly to FIG. 7, at another borehole portion 700 of the example borehole 11 of FIGS. 1-5, the mudcake layer 205 has a relatively lower quality than the borehole portion 600 of FIG. 6. As shown, during a fluid drawing operation, mud filtrate from the borehole 11 leaks through the mudcake layer 205 causing a partial and/or complete hydraulic short 705 of mud filtrate around the probe 515 and the mud filtrate contaminant is drawn into the probe 515 along with and/or instead of fluid from the formation 405.

Returning to FIG. 4, two pressure profile curves 420 and 421 corresponding to two different wellbore pressures $p_{W1}$ and $p_{W2}$ are shown. The wellbore pressures $p_{W1}$ and $p_{W2}$ and the corresponding sandface pressures $p_{SF1}$ and $p_{SF2}$ may be measured, for example by the example LWD module 120 of FIG. 2 and/or the example pressure sensor 1510 of FIG. 15. In general, the higher the mobility of the formation fluid associated with the formation 405, and/or the closer the wellbore pressures $p_{W1}$ and $p_{W2}$ are to an unknown formation pressure $p_0$, the closer the sandface pressures $p_{SF1}$ and $p_{SF2}$ will be to the unknown formation pressure $p_0$. While in general, the invading mud filtrate and the formation fluid may have different viscosities, for simplicity, the effect of viscosity on fluid mobility is neglected herein. However, the effect of viscosity on fluid mobility may be used to enhance the accuracy of the methods and apparatus described herein.

At each pressure overbalance $\Delta p_{overbalance}=p_w-p_0$, mud filtrate continues to invade the formation 405. The velocity v of the mud filtrate invasion can be computed (e.g., estimated) using, for example, Darcy's law, which may be expressed mathematically as:

$$v = \frac{p_W - p_{SF}}{R_m}, \qquad \text{EQN (1)}$$

where $R_m$ is the hydraulic resistance of the mudcake. Using two pairs of wellbore pressures $p_{W1}$ and $p_{W2}$ and the sandface pressures $p_{SF1}$ and $p_{SF2}$, the hydraulic resistance of the mudcake $R_m$ may be computed using the following mathematical expression:

$$R_m = \frac{\Delta p_W - \Delta p_{SF}}{\Delta p_{SF}} R_f, \qquad \text{EQN (2)}$$

where $\Delta P_w=P_{W1}-P_{W2}$, $\Delta p_{SF}=p_{SF2}$, and $R_f$ is the hydraulic resistance of the formation, for which a reasonable estimate is usually known a priori, or may be estimated in situ, as preferred.

By measuring two or more pairs of wellbore pressures $p_{W1}$ and $p_{W2}$ and the sandface pressures $p_{SF1}$ and $p_{SF2}$ and estimating the formation hydraulic resistance $R_f$, an estimate of the invasion velocity v can be computed using EQN (1) and EQN (2). As described below, the invasion velocity v can be used to estimate the amount of mud filtrate leakage that is predicted to occur through the mudcake 205 during a testing operation. As such, the invasion velocity v can be used to make testing decisions.

In practice, care must be taken when applying EQN (2). For example, if the formation fluid mobility is high, such that the sandface pressure $p_{SF}$ is close to the formation pressure $p_0$, the denominator of EQN (2) becomes small creating potential uncertainty in the computed hydraulic resistance $R_m$. However, such instances typically correspond to conditions favorable to building high quality mudcake during drilling, albeit not necessarily corresponding to zero filtrate leakage through the mudcake 205. While EQN (2) uses two pairs of pressure measurements, the hydraulic resistance $R_m$ may be computed using additional pressure measurements to improve accuracy.

Figure 8:
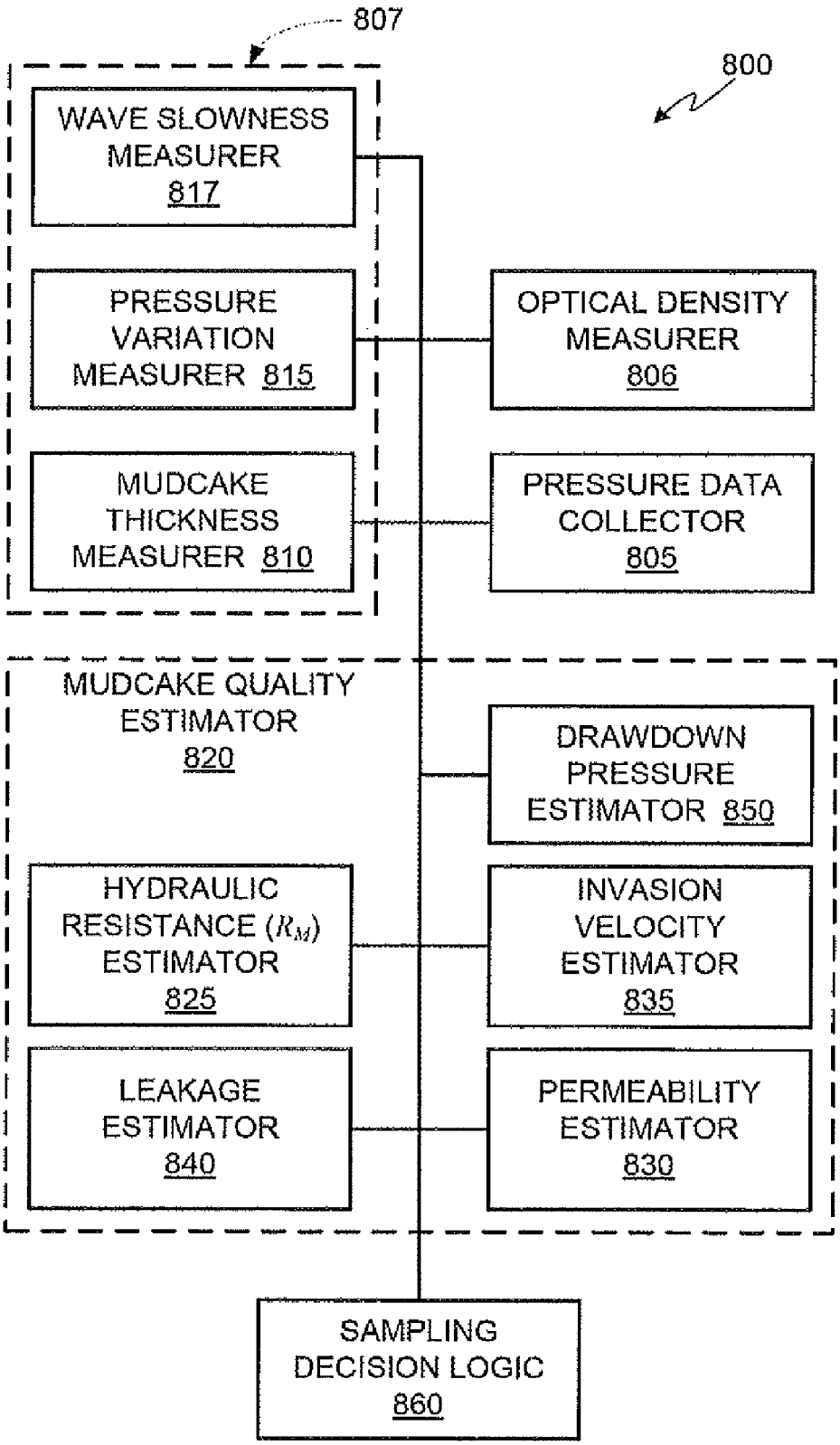
FIG. 8 illustrates an example manner of implementing the example sampling control module of FIG. 3.
Figure 9:
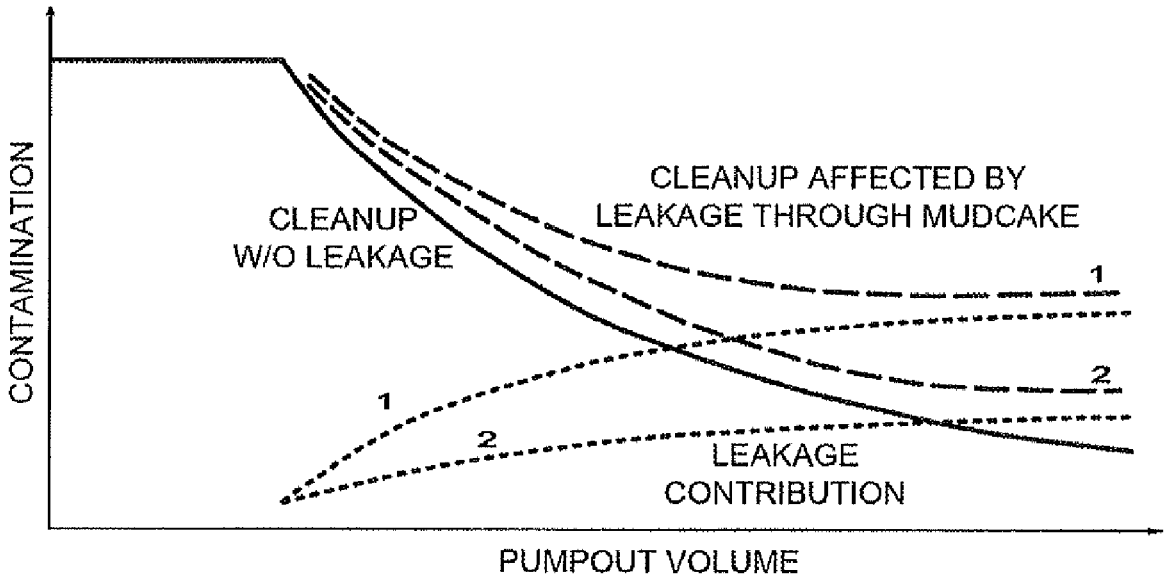
FIG. 9 is a graph illustrating example contamination levels versus fluid pumpout volume.

Turning now to FIG. 8, an example manner of implementing the example sampling control module 330 of FIG. 3 is illustrated. Because the example device of FIG. 8 may be used to implement the example sampling control module 330, and/or a part of the illustrated device of FIG. 8 may used to implement the example surface computer 160 of FIG. 1, the example device of FIG. 8 will be referred to as sampling control module 800.

To measure one or more properties of the example mudcake 205, the example sampling control module 800 of FIG. 8 includes one or more measuring modules, three of which are designated at reference numerals 805, 806, and 807. The example pressure data collector 805 of FIG. 8 measures wellbore pressures, sandface pressures and/or performs a pressure pretest prior to cleanup production. The example pressure data collector 805 may be implemented by the example LWD module 120 of FIG. 2, the example pressure sensor 1510 of FIG. 15, and/or the Schlumberger Stethoscope™ LWD module.

The example optical density measurer 806 of FIG. 8 measures the optical density of sampled fluids, and may be implemented by, for example, the Sehlumberger Optical Fluid Analyzer (OFA™), the Schlumberger Live Fluid Analyzer (LFA™), the Schlumberger Composition Fluid Analyzer (CFA™) or any similar device(s). During cleanup production, the optical density of the sampled fluid changes as the contamination of formation fluid by the mud filtrate 505 changes. In particular, mud filtrate is usually more transparent than formation fluid, which is darker in color.

The example measuring module 807 of FIG. 8 includes a mudcake thickness measurer 810 to measure the thickness of the mudcake layer 205, and a pressure variation measurer 815 to measure a pressure wave variation caused by the mudcake layer 205, and a wave slowness measurer 817 to measure the compressional slowness and/or the shear slowness of pressure waves passing through the mudcake layer 205. Example manners of implementing the example measuring module 807 of FIG. 8 are described below in connection with FIGS. 13A, 13B, and 14-16, 17A and 1713.

To estimate the quality of the mudcake layer 205, the example sampling control module 800 of FIG. 8 includes a mudcake quality estimator 820. Based on one or more properties of the mudcake 205 measured by one or more of the measuring modules 805-807, the example mudcake quality estimator 820 computes a value that represents an estimate amount of mud filtrate that will leak through the mudcake 205 during a testing operation.

To estimate a hydraulic resistance $R_m$ the example mudcake quality estimator 820 of FIG. 8 includes a hydraulic resistance estimator 825. The example hydraulic resistance estimator 825 computes (e.g., estimates) a mudcake hydraulic resistance $R_m$ using pressure and/or pressure pretest measurements taken by the example pressure data collector 805 by, for example, using EQN (2) described above. Additionally or alternatively, the example hydraulic resistance estimator 825 can compute a hydraulic resistance $R_m$ using a mudcake thickness δ measured by the example measuring module 807, and a mudcake permeability $k_m$ computed by a permeability estimator 830. Mudcake hydraulic resistance $R_m$ can be mathematically expressed as:

$$R_m = \frac{\mu_f \delta}{k_m}, \quad \text{EQN (3)}$$

where $\mu_f$ is the viscosity of the mud filtrate, which is usually known, at least approximately, a priori. Alternatively, the permeability estimator 830 may determine a mud filtrate mobility in the mudcake $k_m/\mu_f$.

The example permeability estimator 830 of FIG. 8 computes (e.g., estimates) a mudcake permeability k, (or a mud filtrate mobility in the mudcake $k_m/\mu_f$) based on the pressure variation measurements taken by the example pressure variation measurer 815. As described below in connection with FIG. 15, the pressure variations are caused when a pressure wave passes through the mudcake layer 205. The pressure wave received through the mudcake 205 is measured by the example pressure variation measurer 815, as described below in connection with FIG. 15. Knowing the pressure associated with the pressure wave and generated in the formation, both a magnitude or amplitude variation Δp and a time variation Δt of the measured wave relative to the pressure wave generated in the formation can be computed by the example pressure variation measurer 815. A phase shift of the pressure wave α due to the mudcake 205 can be calculated from the time variation Δt. For example, the phase shift a can be computed as α=ωΔt, where ω is the frequency of the pressure wave. The pressure diffusivity of the mudcake 205 can be computed, for example using a one-dimensional model of pressure diffusion across the thickness of the mudcake, such as:

$$\eta_m = \frac{\omega}{2}\left(\frac{\delta}{\alpha}\right)^2 = \frac{k_m B_m}{\phi_m \mu_f}, \quad \text{EQN (4)}$$

where δ is the thickness of the mudcake 205, $B_m$ is the bulk modulus of the mudcake 205, $\Phi_m$ is the porosity of the mudcake 205, $k_m$ is the mudcake permeability, and $\mu_f$ is the viscosity of the mud filtrate. However, more-complex models involving one or more partial differential equations describing pressure transmission through the mudcake 205 may be used to estimate the mudcake diffusivity $\eta_f$.

Knowing the phase shift α, the frequency of the pressure wave ω, the mudcake thickness δ, the bulk modulus $B_m$, the porosity $\phi_m$, and the viscosity μ, the mudcake permeability $k_m$ can be computed using EQN (4). For simplicity, the porosity $\phi_m$ which varies in a small range of values, can be assumed to be a constant, and mudcake thickness δ can be measured, as described below in connection with FIGS. 16 and 17. However, the bulk modulus $B_m$ can vary significantly and is affected by the differential pressure across the thickness of the mudcake 205, and/or with one or more properties of the mud filtrate and/or mudcake 205 (e.g., a particle size distribution, a particle shape distribution, etc.). As described below in connection with FIG. 16, the bulk modulus $B_m$ can be estimated using a high-frequency sensor operated in both compressional and shear modes of acoustic wave propagation.

To compute (e.g., estimate) a mud filtrate invasion velocity v, the example mudcake quality estimator 820 of FIG. 8 includes an invasion velocity estimator 835. Based on a computed hydraulic resistance $R_m$ and a pair of wellbore and sand face pressure measurements, the example invasion velocity estimator 835 computes an expected invasion velocity v by, for example, using EQN (1) described above.

To compute (e.g., estimate) an amount of mud filtrate leakage that is expected to occur through the mudcake 205 during a testing operation, the example mudcake quality estimator 820 includes a leakage estimator 840. Based on a pumpout rate of the sampling tool 510, the expected mud filtrate invasion velocity v and the computed mudcake hydraulic resistance $R_m$, the example leakage estimator 840 estimates, as a function of pumpout time, the portion of a sampled fluid that will be mud filtrate. FIG. 9 illustrates mud filtrate contamination levels as a function of pumpout volume and/or equivalently the time for which the sampling tool 510 pumps a fluid out the formation 405. As shown in FIG. 9, at first the sampling tool 510 extracts contaminated fluids as only fluid from the invasion zone 415 is being pumped by the sampling tool. As pumpout continues, both virgin fluid from the formation 405 and mud filtrate 505 that leaks through the mudcake 205 will be pumped. The contamination level of mud filtrate 505 in the sampled fluid depends upon the leakage rate of the mudcake 205. The more leakage, the greater the minimum contamination level that can be achieved. If the leakage rate is great enough and/or the pumpout rate of the sampling tool 510 is insufficient, a fluid sample having an acceptable level of contamination may not be achievable. While mud filtrate contamination level curves are depicted in FIG. 9, it should be appreciated that fluid property curves may be used alternatively. Indeed, methods for computing contamination level curves from fluid property curves are well known in the art. Trends and behaviors exhibited in contamination level curves usually correspond to equivalent trends and behaviors exhibited in fluid property curves.

Figure 10:
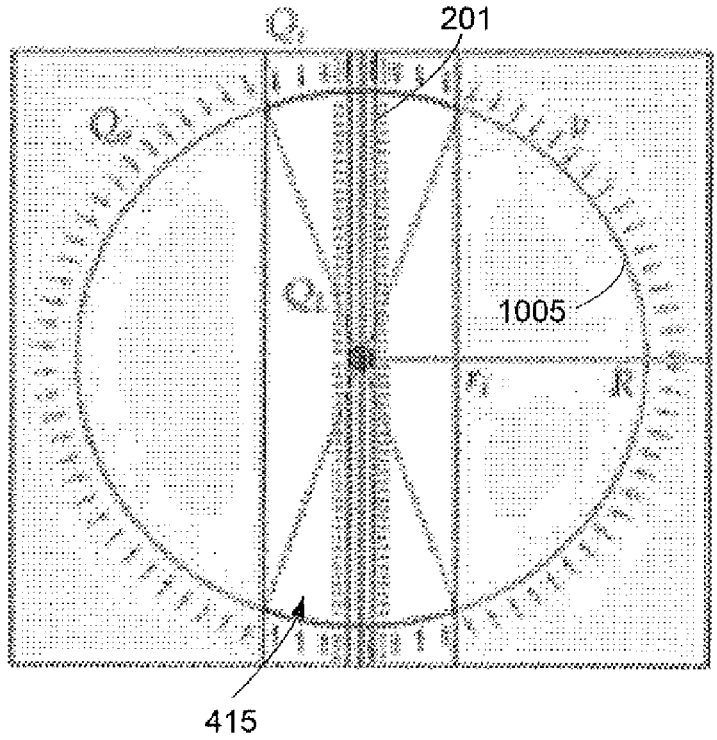
FIG. 10 illustrates an example fluid flow model that may be used to estimate contamination due to mud filtrate leakage through a mudcake layer.

Turning now to FIG. 10, a fluid flow model is shown that may be used to compute (e.g., estimate) the contribution to a sampled fluid of mud filtrate 505 leaking through the mudcake 205. The example fluid flow model of FIG. 10 is based on a spherical flow to a point sink (e.g., the sampling tool 510). However, any geometrical flow model may be used to estimate the contamination of fluid samples by mud filtrate leakage through the mudcake 205. In FIG. 10, the pumpout volume V of the sampling tool 510 is represented by a production sphere 1005. As the sampling tool 510 continues to pump fluid, the radius R of the sphere 1005 increases overtime time in proportion to the pumpout rate $Q_p$ of the sampling tool 510. The radius R(t) of the production sphere 1005 has to become larger than the radius $r_i$ of the invasion zone 415 in order to start reducing the contamination of the sampled fluid by the mud filtrate 505. The pumpout rate of the sampling tool 510 can be expressed as $$Q_p = Q_0(R(t)) + Q_f(R(t)) + Q_L)(R(t)), \quad \text{EQN (5)}$$

where $Q_0$ is the total flow rate of virgin formation fluid through the boundary of the sphere 1005, $Q_f$ is the flow rate of mud filtrate 505 through the boundary of the production sphere intersected by the cylindrical invasion zone 415, and $Q_L$ is the leakage rate of the mud filtrate 505 through the borehole wall 201 inside the production sphere 1005, and R(t) is the radius of the production sphere 1005 as a function of time.

The contamination of fluid produced by the sampling toot 510 can be expressed by the following ratio:

$$\eta = \frac{Q_f + Q_L}{Q_P} = \frac{Q_f}{Q_P} + \frac{Q_L}{Q_P}, \quad \text{EQN (6)}$$

where the second term represents contamination due to mud filtrate leakage through the mudcake 205. For modest leakage rates, first term can be estimated as $$\frac{Q_f}{Q_P}(t) \approx \frac{r_i^2 - r_w^2}{R(t)^2}, \quad \text{EQN (7)}$$

where $r_w$ is the wellbore radius. The amount of contamination due to mud filtrate leakage, as a function of time, can be estimated as:

$$\frac{Q_L}{Q_p}(t) \approx \frac{4\pi r_w R(t) v}{Q_p}, \quad \text{EQN (8)}$$

where v is the estimated invasion velocity of the mud filtrate 205. The radius of the production sphere as a function of time can be expressed as $$R(t) = \left(\frac{3V(t)}{4\pi}\right)^{1/3}. \quad \text{EQN (9)}$$

For a constant pumpout rate $Q_p$, the value of EQN (7) decreases as a function of $V^{2/3}$, while the value of EQN (8) increases as function of $V^{1/3}$. As such, the initial cleanup trends illustrated in FIG. 9 will at some point be reversed due to leakage of mud filtrate 505 through the mudcake 205. For simplicity, the mathematical expression of EQN (8) can be used to determine whether to initiate a testing operation. For example, if the value of $Q_L/Q_p$ is greater than a threshold (e.g., 0.01) for all time (or over a maximum acceptable cleanup pumpout time period), then testing operations need not be initiated. Instead, drilling could be restarted and/or the sampling tool 510 repositioned to an area having a better mudcake quality. While the example mathematical expression of EQN (8) is used herein to determine whether to initiate a testing operation, both EQN (7) and EQN (8) could be used to make the sampling decisions.

Figures 11, 12:
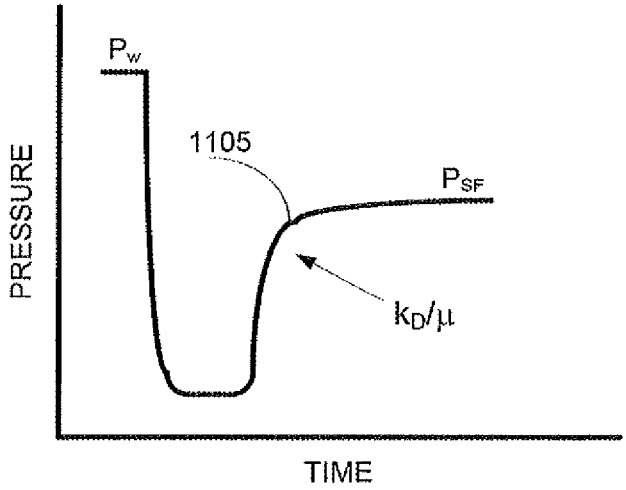
FIG. 11 is a graph illustrating example pretest pressure buildup data.
FIG. 12 is a table showing example properties of various testing probes.

Returning to FIG. 8, to estimate a drawdown pressure, the example mudcake quality estimator 820 includes a drawdown pressure estimator 850. Based upon pressure pretest measurements taken by the example pressure data collector 805, the example drawdown pressure estimator 850 of FIG. 8 computes (e.g., estimates) a drawdown pressure that is expected to occur when pumpout is being performed by the sampling tool 510. During a pumpout pretest, the example pressure data collector 805 (e.g., the example pressure sensor 1510 of FIG. 15) collects pressure buildup data; A graph of example pretest pressure buildup data is illustrated in FIG. 11. As shown in FIG. 11, the formation sandface pressure psi (a close approximation of the formation pressure $p_0$) and the drawdown mobility of the formation $k_D/\mu$ can be determined (e.g., estimated) from the pressure buildup data. In particular, the terminal pressure represents the formation sandface pressure $p_{SF}$ and the curve and/or slope 1105 of the pressure buildup curve can be used to determine the drawdown mobility $k_D/\mu$. An example manner of estimating the drawdown mobility of the formation $k_D/\mu$ is described in U.S. Pat. No. 7,117,734.

An estimate of the drawdown pressure $\Delta p_E$ (i.e. the pressure difference between $p_{SF}$, the formation sandface pressure, and the pumping pressure) that will occur during a steady state pumping rate performed by the sampling tool 510 can be expressed as:

$$\Delta p_E = F_s \frac{Q_p}{(k_D/\mu)}, \quad \text{EQN (10)}$$

where $Q_p$ is the production rate of the sampling tool 510 expressed in cubic centimeters (cc) per second (cc/s), $k_D/\mu$ is the drawdown mobility expressed in milliDarcies (mD) per centipoise (cP) (mD/cP), $\Delta p_E$ is the drawdown pressure in pounds per square inch (psi), and $F_s$ is a shape factor, which as a dimension of inverse length. Shape factors for a variety of exemplary Schlumberger Modular Formation Dynamics Tester (MDT™) probe types are listed in FIG. 12. An estimated drawdown pressure $\Delta p_E$ during cleanup production may be obtained from EQN (10) using an actual pumpout rate $Q_p$ and the drawdown mobility $k_D/\mu$ determined from pretest pressure buildup data as illustrated in FIG. 11. The actual pumpout rate $Q_p$ may be measured and/or estimated by, for example, counting the strokes of a displacement unit of a Schlumberger MDT™ probe and/or counting roller screw rotations of a reciprocating pump.

During sampling, an actual drawdown pressure $\Delta p_{actual}$ corresponding to the actual pumpout rate $Q_p$ is measured. If the estimated drawdown pressure $\Delta p_E$ is approximately the same as the actual drawdown pressure $\Delta p_{actual}$, then severe mud filtrate leakage through the mudcake 205 is unlikely. However, if $\Delta p_E$ is substantially higher than $\Delta p_{actual}$, then the likelihood of substantial leakage is high. In the illustrated example it is assumed that the probe 515 provides a local seal between the wellbore 11 and the mudcake 205 and thereby the filtrate leakage is negligible, whereas during sampling, mud filtrate leakage (hydraulic shortcut 705) occurring beyond the seated portion of the wellbore wall 320 will be detectable and translates into a smaller than anticipated actual drawdown pressure $\Delta p_{actual}$. While this scenario is described in detail herein, other scenarios may be envisaged and would not necessarily translate into estimated drawdown pressure $\Delta p_E$ higher or less than actual drawdown pressure $\Delta p_{actual}$.

Returning to FIG. 8, to make testing decisions, the example sampling control module 800 of FIG. 8 includes sampling decision logic 860. The example sampling decision logic 860 of FIG. 8 uses one or more values representative of mudcake leakage, as computed by the example mudcake quality estimator 820, to make sampling decisions. In a presently preferred example, the example permeability estimator 830, the example hydraulic resistance estimator 825 and the example leakage estimator 850 compute a first leakage estimate based on measurements performed by the example pressure variation measurer 815 and the example mudcake thickness measurer 810. The sampling decision logic 860 uses the first leakage estimate to determine whether to initiate a testing operation. If the first leakage estimate indicates that testing is to be initiated, the example drawdown pressure estimator 850 estimates a drawdown pressure based on pretest pressure build data collected by the pressure data collector 805. The sampling decision logic 860 compares the estimated drawdown pressure to an actual drawdown pressure to determine a second leakage estimate. If the estimated and actual drawdown pressures differ by more than a threshold (i.e., signifying that significant mudcake leakage is likely), then the sampling decision logic 860 terminates the sampling operation. If the sampling operation is to continue, the sampling decision logic 860 monitors optical density data measured by the example optical density measurer 806 to detect fault conditions (e.g., a fracture and/or fissure in the formation 405, a faulty sampling probe, etc.). For example, if the optical density does not change within a specific period of time, the sampling decision logic 860 terminates the sampling operation.

While an example manner of implementing a sampling control module 800 has been illustrated in FIG. 8, one or more of the interfaces, data structures, elements, processes and/or devices illustrated in FIG. 8 may be combined, divided, rearranged, omitted, eliminated and/or implemented in any other way. For example, the example measurers 805-807 may be implemented in the example BHA 100 (e.g., by one or more of the LWD modules 120, 120A), and the example mudcake quality estimator 820 and the example sampling decision logic 860 implemented by the example surface computer 160. Further, the example measuring modules 805-807, the example mudcake thickness measurer 810, the example pressure variation measurer 815, the example mudcake quality estimator 820, the example hydraulic resistance estimator 825, the example permeability estimator 830, the example invasion velocity estimator 835, the example leakage estimator 840, the example drawdown pressure estimator 850, the example sampling decision logic 860 and/or, more generally, the example sampling control module 800 of FIG. 8 may be implemented by hardware, software, firmware and/or any combination of hardware, software and/or firmware. Thus, for example, any or all of the example measuring modules 805-807, the example mudcake thickness measurer 810, the example pressure variation measurer 815, the example mudcake quality estimator 820, the example hydraulic resistance estimator 825, the example permeability estimator 830, the example invasion velocity estimator 835, the example leakage estimator 840, the example drawdown pressure estimator 850, the example sampling decision logic 860 and/or, more generally, the example sampling control module 800 may be implemented by one or more circuit(s), programmable processor(s), application specific integrated circuit(s) (ASIC(s)), programmable logic device(s) (PLD(s)) and/or field programmable logic device(s) (FPLD(s)), etc. Further still, a sampling control module may include interfaces, data structures, elements, processes and/or devices instead of, or in addition to, those illustrated in FIG. 8 and/or may include more than one of any or all of the illustrated interfaces, data structures, elements, processes and/or devices.

Figure 13A:
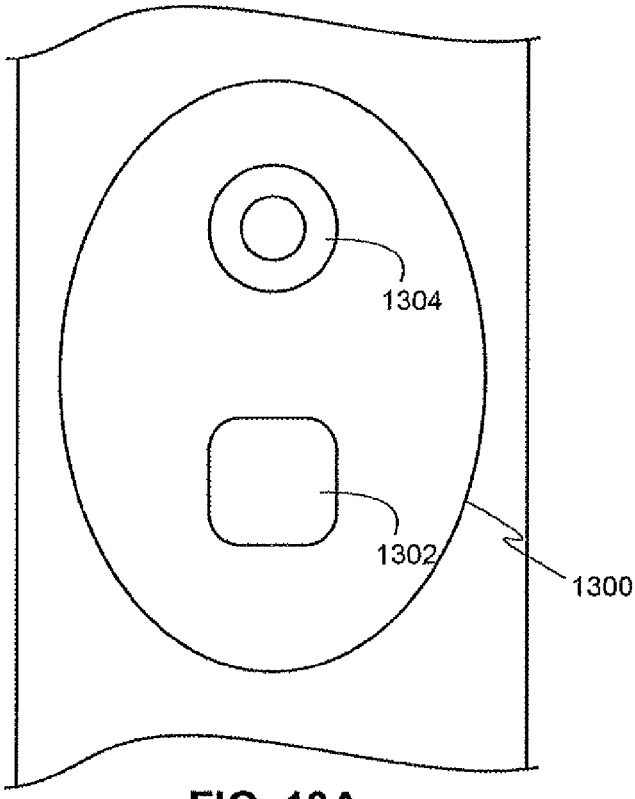
FIGS. 13A, 13B, 14, 15 and 16 illustrate example devices that may be used to measure one or more properties of a mudcake layer.
Figure 13B:
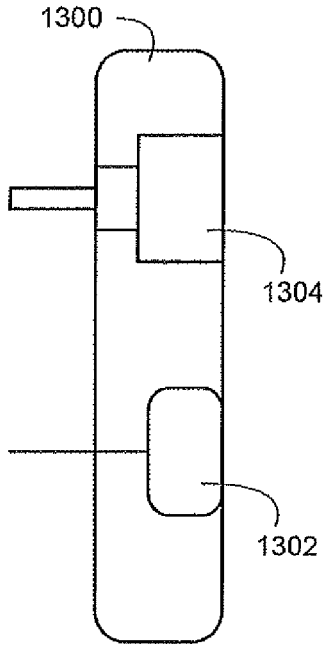

FIGS. 13A and 13B depict an example probe packer assembly 1300 than can be used to implement the example pressure variation measurer 815 of FIG. 8. The example measurement pad 1600 of FIG. 16 can be used to measure a pressure variation through the mudcake 205. In the illustrated example, the probe packer assembly 1300 includes a low-frequency acoustic sensor 1302 and a probe inlet 1304. In the illustrated example, the probe packer assembly 1300 is configured to create and measure a transient differential pressure through the mudcake layer 205. The distance between the acoustic sensor 1302 and the probe inlet 1304 is chosen such that the mudcake located between the sensor 1302 and the probe inlet 1304 would not be washed out during a pressure pretest. The transient pressure variation measured by the example probe packer assembly 1300 may be used, as describe above, to estimate a mudcake permeability $k_m$. The example probe packer assembly 1300 may be implemented by any of the example LWD modules 120, 120A, 300 described herein.

Figure 14:
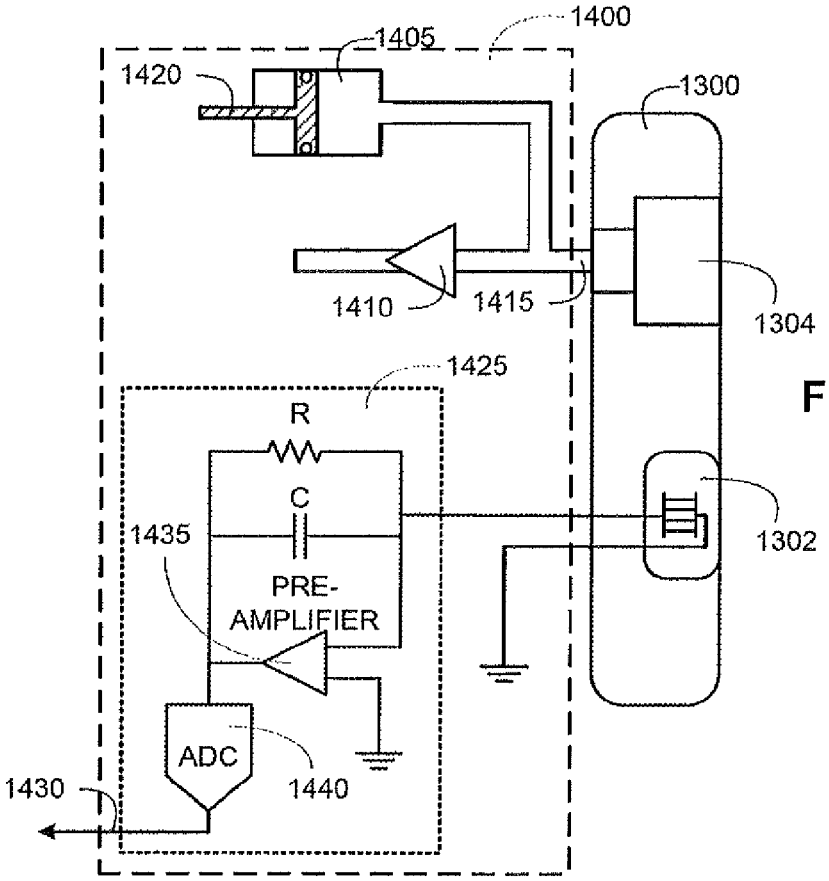
Figure 15:
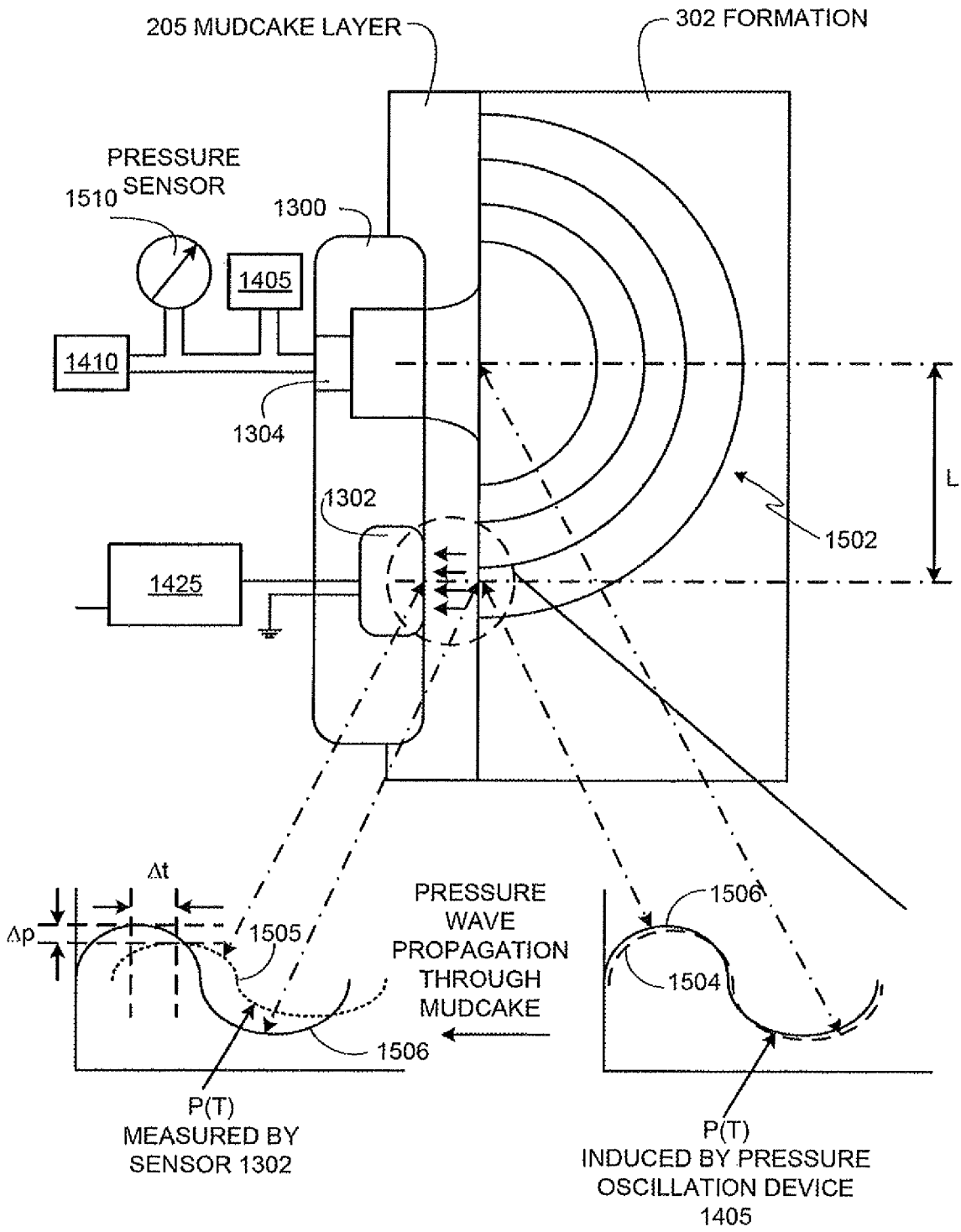

FIG. 14 depicts the example probe packer assembly 1300 of FIGS. 13A and 13B coupled to an example measuring apparatus 1400 that can be used to generate pressure waves 1502 that propagate through the mudcake layer 205 and the formation 302 as shown in FIG. 15, and to detect the low-frequency pressure waves 1502 propagating back through the mudcake layer 205.

To create the pressure waves 1502, the example measuring apparatus 1400 of FIG. 14 includes a pressure oscillation or pressure pulsing device 1405 and an isolation valve 1410. The pressure oscillation device 1405 is connected to a flowline 1415 of the probe packer 1300. By moving a piston 1420 of the pressure oscillation device 1405, the pressure waves 1502 are transmitted into the formation 302, as illustrated in FIG. 15. The example isolation valve 1410 of FIG. 14 prevents pressure waves created by the example pressure oscillation device 1405 from propagating back into other portions of the measuring apparatus 1400, and/or to prevent other portions of the measuring apparatus 1400 from interfering with pressure variation measurements performed via the example sensor 1302.

To convert sensed pressure wave into digital signals, the example measuring apparatus 1400 of FIG. 14 includes a receive electronics module 1425. The example receive electronics module 1425 of FIG. 14 converts an analog signal received from the example sensor 1302 into a digital signal 1430. The example receive electronics module 1425 includes an amplifier 1435 and an analog-to-digital converter (ADC) 1440. In the illustrated example of FIG. 14, the sensor 1302 comprises a lead titanate (PT) piezoelectric sensor. The example amplifier 1435 of FIG. 14 amplifies the analog output signal of the piezoelectric sensor 1302 to a voltage level suitable for conversion to a digital signal by the example ADC 1440. As shown, the amplifier 1435 may include a low-pass filter to reduce the effects of aliasing that may be introduced by the ADC 1440. Any number and/or type(s) of amplifier circuit(s) and/or ADC(s) may be used instead of, or in addition to, those shown in FIG. 14.

Turning to FIG. 15, the pressure waves 1502 transmitted via the inlet 1304 propagate through the formation 302. As shown in FIG. 15, they will also propagate through the mudcake 205 and be detected by the low-frequency acoustic sensor 1302. The example pressure waves 1502 and the example acoustic sensor 1302 are of a low-frequency type (e.g. a Biot slow compressional wave) in order to capture pressure waves propagating slowly through the formation 302 and the mudcake 205. The low-frequency sensor 1302 is used to estimate pressure variations, which can be used as described above to determine a mudcake diffusivity $\eta_m$ using, for example, EQN (4).

To measure the pressure of the pressure waves 1502 transmitted by the example pressure oscillation device 1405, the example packer 1300 of FIG. 15 includes any type of pressure sensor 1510. An example representation of a pressure signal measured by the pressure sensor 1510 is shown as pressure curve 1504 in FIG. 15. Additionally or alternatively, the example pressure sensor 1510 may be used to measure wellbore pressures, sandface pressures, drawdown pressures and/or pretest pressure buildup data.

As the pressure waves 1502 propagate through the mudcake 205 their magnitude and/or phase will be affected. In particular, the pressure wave 1502 is received at the acoustic sensor 1302 as a pressure curve 1505. The pressure curve 1505 differs from a pressure curve 1506 that would be measured at the interface between the formation 302 and the mudcake 205, in front of the acoustic sensor 1302, in amplitude (e.g., magnitude) and/or time (e.g., phase). The difference in amplitude can be expressed as Δp, and the difference in time can be expressed as Δt. It should be appreciated that the pressure curve 1505 may differ from a pressure curve 1506 for other reasons, such as propagation in the structure sensor 1302. However, it is assumed here for simplicity that these differences are negligible, or can be corrected for, using calibrations procedures for example.

The pressure curve 1506 may be estimated using any number and/or type(s) of method(s), equation (s) and/or algorithm(s). For example it can be calculated by solving partial differential equations of pressure waves propagating in the formation 302, using measured or estimated properties of the formation 302 and data related to the creation of the pressure waves by the pressure oscillation or pressure pulsing device 1405. In other cases, such as when the formation pressure diffusivity η significantly larger than the mudcake diffusivity $\eta_m$, it is possible to operate the pressure oscillation or pressure pulsing device 1405 in such a way that the pressure curve 1504 measured by the sensor 1510 and the pressure curve 1506 are almost identical, as further detailed below. Thus in this case, pressure variation measurements Δp and Δt may be determined from the differences (in magnitude and delay, respectively) between pressures measured by the example pressure sensor 1510 and the example acoustic sensor 1302.

When operating the pressure oscillation or pressure pulsing device 1405 in such a way that the pressure curve 1504 measured by the sensor 1510 and the pressure curve 1506 are almost identical, the frequency of the pressure waves 1502 transmitted by the pressure oscillation device 1405 may be selected such that the pressure in the probe inlet 1304 is approximately equal to the pressure behind the mudcake opposite the acoustic sensor 1302. At this frequency and lower, a one-dimensional model of pressure diffusion across the thickness of the mudcake, such as that shown in EQN (4) can be used to characterize the mudcake 205 based on pressure variations measured by the example acoustic sensor 1302. The frequency may be selected or determined based on one or more parameters, such as the distance L between the inlet 1304 and the acoustic sensor 1302, and the formation pressure diffusivity η. For a separation distance of L and a formation pressure diffusivity of q, the propagation time $t_L$ of the pressure waves from the inlet 1304 to the acoustic sensor 1302 can be expressed mathematically as:

$$t_L = L^2/\eta. \qquad \text{EQN (11)}$$

The propagation time $t_L$ can be used to choose an appropriate frequency for the pressure waves 1502. For example, the frequency can be selected as the inverse of the propagation time (i.e., frequency=$1/t_L$). For a formation having a permeability of 100 mD, a fluid viscosity of 1 cP, a porosity of 20%, and a compressibility of $10^{-9}$ inverse Pascal ($Pa^{-1}$), the formation pressure diffusivity η is 0.5 $m^2s^{-1}$. Using this value and a separation distance L of 5 centimeters (cm), the propagation time $t_L$ is approximately 5 milliseconds (ms), which corresponds to a pressure wave frequency of 200 cycles per second (Hz). In general, the pressure wave frequency is proportional to the formation permeability. Thus, for a formation permeability of 1 mD, a pressure wave frequency of 2 Hz would be appropriate.

Figure 16:
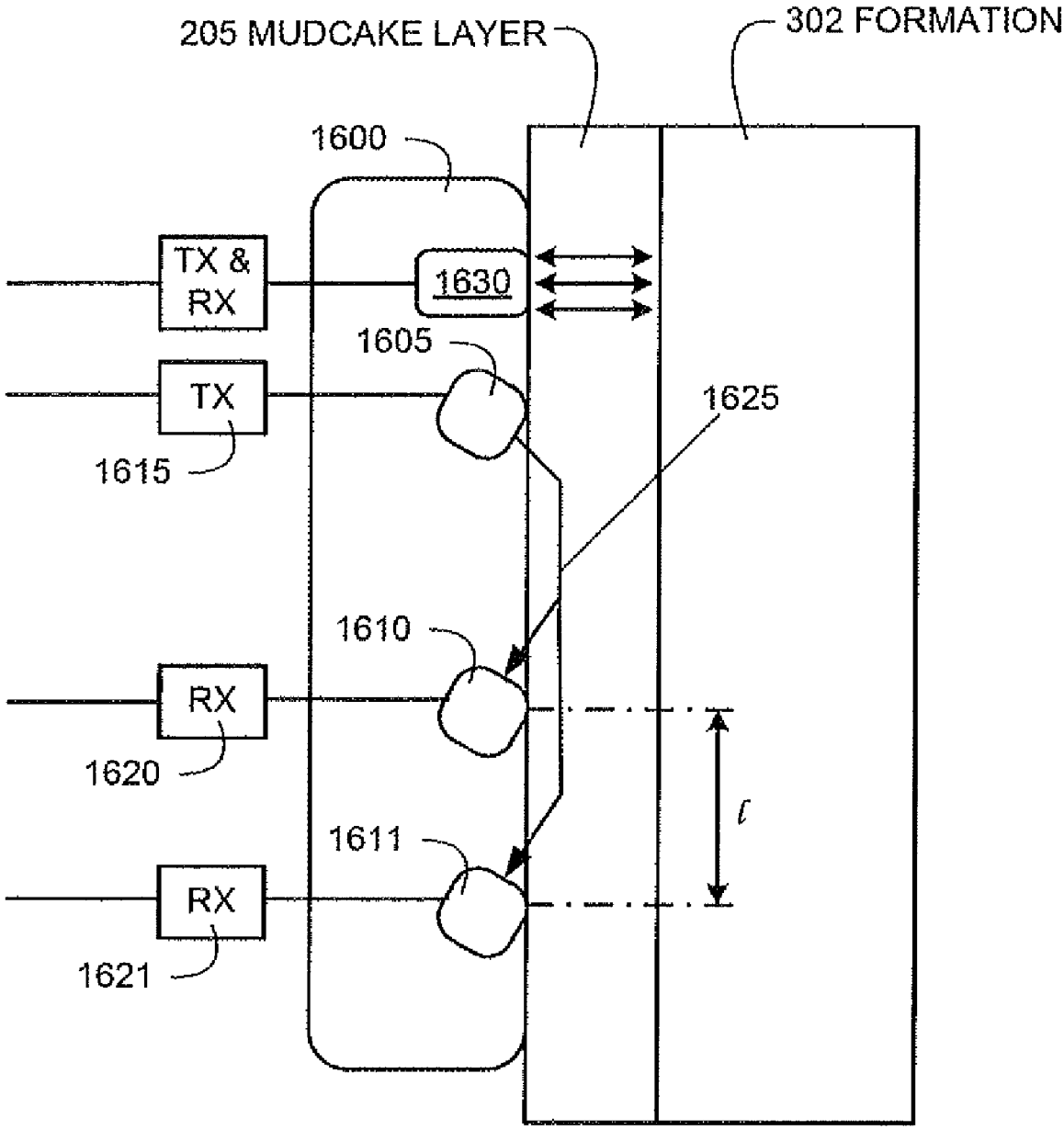

FIG. 16 illustrates an example measurement pad 1600 than can be used to implement the example wave slowness measurer 817 and/or the example mudcake thickness measurer 810 of FIG. 8. The example measurement pad 1600 of FIG. 16 can be used to determine wave slowness (i.e., inverse of wave velocity) and/or a mudcake thickness 6. The example measurement pad 1600, can, for example, be integrated with the example probe packer assembly 1300 of FIG. 15, and/or may be constructed similarly to the example packer assembly of FIGS. 13A, 13B, 14 and/or 15.

To implement the example wave slowness measurer 817 of FIG. 8, the example measurement pad 1600 of FIG. 16 includes an oblique transmitter 1605 and two oblique receivers 1610 and 1611 spaced apart by a distance l. As described below, the example oblique transmitter 1605 and the example oblique receivers 1610 and 1611 of FIG. 16 can be operated to measure compressional wave slowness and/or shear wave slowness. The example oblique transmitter 1605 of FIG. 16 operates at ultrasonic frequencies, as discussed below in connection with EQN (13). While two receivers 1610 and 1611 are shown in FIG. 16, three or more receivers may be used. The example transmitter 1605 is controlled by a transmit electronics module 1615. The example receivers 1610, 1611 are coupled to respective receive electronics modules 1620 and 1621 that, in some examples, are similar to the example receive electronics module 1425 of FIG. 14. The transmitter 1605 emits a wave at a frequency high enough to generate refracted waves (e.g. compressional and shear waves) in the mudcake layer 205, as indicated by arrows 1625.

Figure 17A:
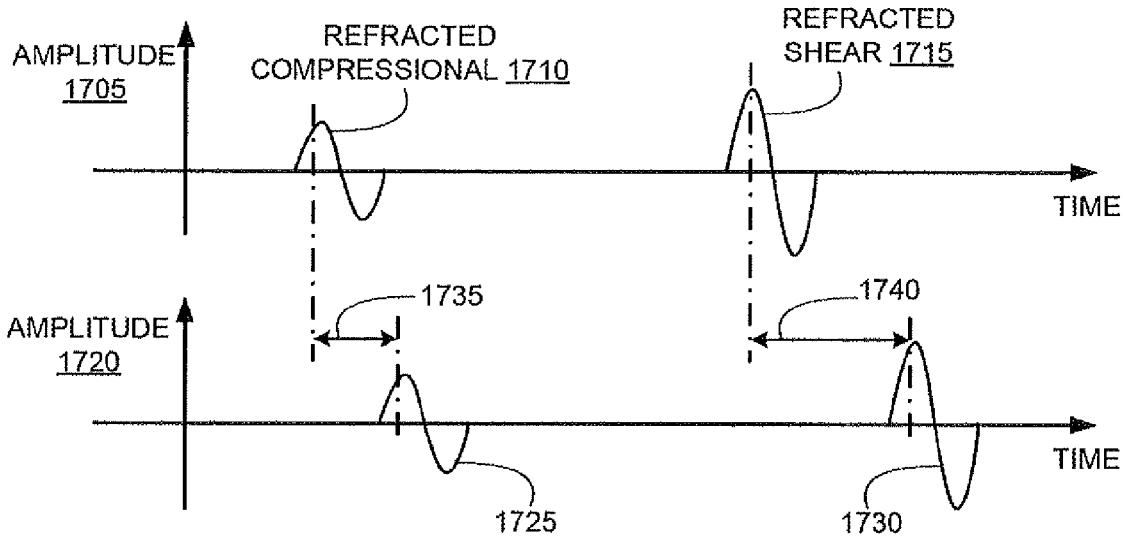
FIGS. 17A and 17B are timing diagrams of example time-based relationships between ultrasonic signals in a two-layer media formed by a mudcake layer and a formation.

Examples signals collected by the example receivers 1610 and 1611 are shown in FIG. 17A. The upper graph of FIG. 17A shows an example measured signal 1705 at the receiver 1610. The example signal 1705 includes a refracted compressional wave 1710 and, in some cases, a refracted shear wave 1715. The lower graph of FIG. 17A shows an example measured signal 1720 at the receiver 1611, which is further away from the transmitter 1605 than the receiver 1610. The example signal 1720 includes a refracted compressional wave 1725 and, in some cases, a refracted shear wave 1730. The arrival time difference 1735 of the compressional waves 1710 and 1725 is equal to the product of the compressional wave slowness (i.e. the inverse of the compressional wave velocity $v_p$) and the distance l between the receivers 1610 and 1611. The arrival time difference 1740 of the shear waves 1715 and 1730 is equal to the product of the shear wave slowness (i.e. the inverse of the shear wave velocity $v_s$) and the distance/between the two receivers 1610 and 1611. Alternatively, the shear wave velocity $v_s$ can be determined from the compressional wave velocity $v_p$, for example using an empirical correlation between shear wave velocity $v_s$ and compressional wave velocity $v_p$.

A bulk modulus $B_m$ can be computed using the compressional and shear wave slownesses. For example, the bulk modulus $B_m$ may be computed using the following mathematical expression:

$$B_m = \rho\left(v_p^2 - \frac{4}{3}v_s^2\right). \qquad \text{EQN (12)}$$

where ρ is mudcake density, $v_p$ is the compressional wave velocity and $v_s$ is the shear wave velocity measured by, for example the example wave slowness measurer 817 of FIG. 8.

Figure 17B:
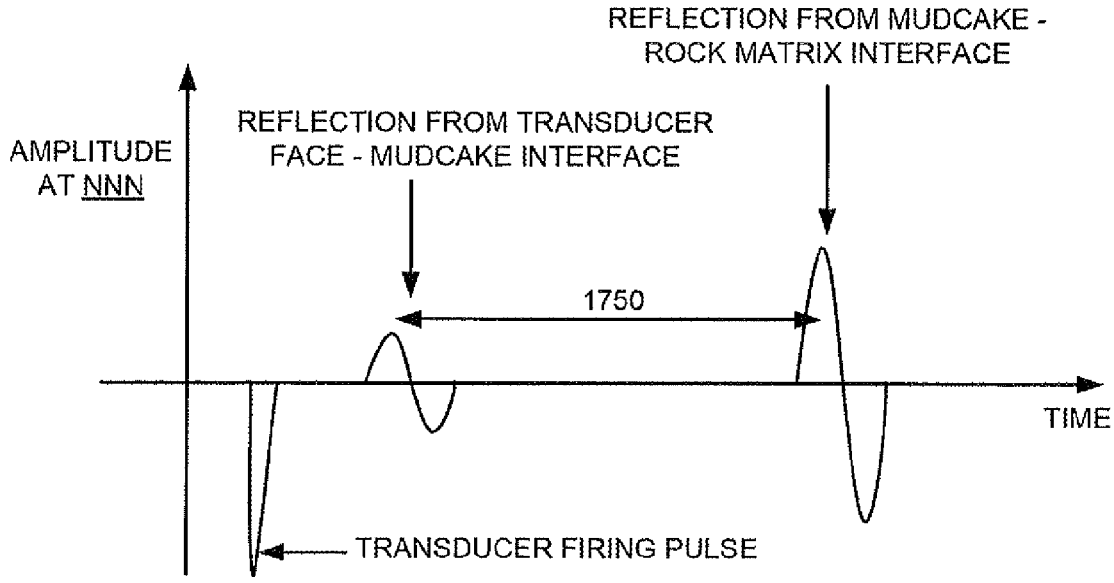

Returning to FIG. 16, to implement the example mudcake measurer 810 of FIG. 8, the example measuring pad 1600 of FIG. 16 includes a high-frequency acoustic sensor 1630. In the illustrated example, the high-frequency (e.g., ultrasonic) sensor 1630 is used to determine in situ mudcake thickness δ. The example high-frequency sensor 1630 of FIG. 16 operates in a pulse-echo mode at high frequency and low amplitude. In general, the example sensor 1630 transmits a pulse and listens for reflections. As illustrated in FIG. 17B, reflections will be received for each transmitted pulse. Time differences between the transmitted and received reflections can be used to determine mudcake thickness δ by applying the principles of time-domain reflectometry. For example, a time difference Δt 1750 between reflections caused by the front and back faces of the mudcake 205 can be used to estimate the mudcake thickness δ. The mudcake thickness δ can be computed as the compressional wave velocity $v_p$ of the mudcake 205 multiplied by half of the time difference Δt 1750, where $v_p$ is determined, for example, using the example oblique transmitter 1606 and the example receivers 1610 and 1611, as described above.

The frequency(-ies) of the pulses transmitted by the example sensor 1630 and/or the example oblique transmitter 1605 are selected based on an expected thickness δ of the mudcake 205 and the compressional wave velocity $v_p$ of the mudcake 205. For example, the frequency can be estimated as:

$$f_H = v_p/\delta \qquad \text{EQN (13)}$$

For a mudcake thickness δ of 1 millimeter (mm) and a compressional wave velocity $v_p$ of 1 kilometers (km) per second(s) (km/s), the pulse frequency needs to be at least 1 million cycles per second (MHz). Higher frequencies (e.g., 10 MHz) may be used to improve the resolution of the mudcake thickness measurement. However, for thicker and/or more attenuative mudcakes 205 lower frequencies (e.g., 0.5 MHz or 1 MHz) are used.

While example manners of implementing packer assemblies have been illustrated in FIGS. 13A, 13B, and 14-16, one or more of the elements illustrated in FIGS. 13A, 13B, 14-16 may be combined, divided, re-arranged, omitted, eliminated and/or implemented in any other way. Further, the example sensor 1302, the example measuring apparatus 1400, the example pressure oscillation device 1405, the example receive electronics module 1425, the example amplifier 1435, the example ADC 1440, the example transmitter 1605, the example receivers 1610, the example transmit electronics module 1615, the example receive electronics modules 1620, 1621, and/or the example sensor 1630 may be implemented by hardware, software, firmware and/or any combination of hardware, software and/or firmware. Further still, a packer assembly may include devices, sensors, pumps, sample containers, control elements, interfaces, data structures, and/or elements instead of, or in addition to, those illustrated in FIGS. 13A, 13B, and 14-16 and/or may include more than one of any or all of the illustrated elements.

Figure 18:
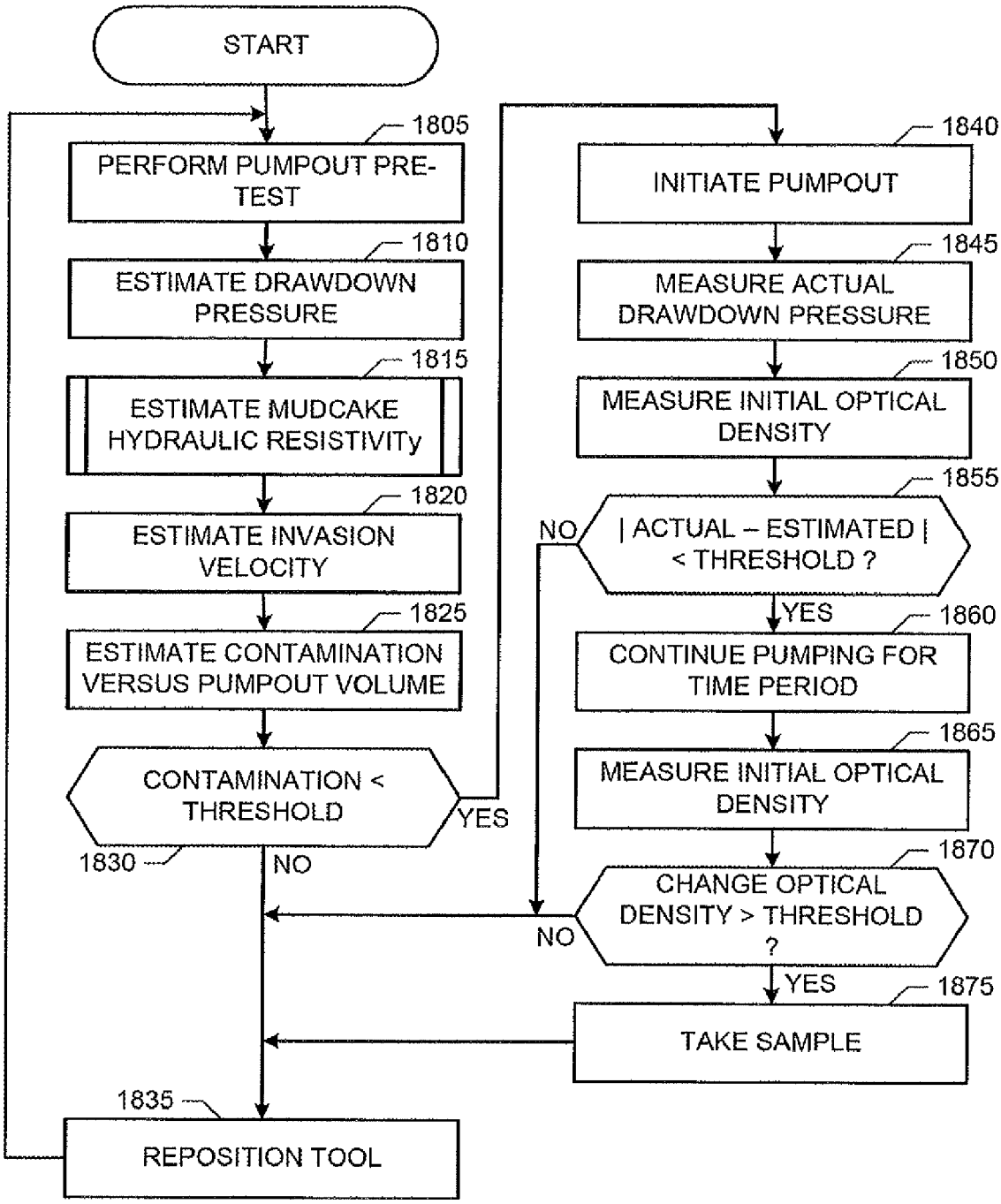
FIGS. 18, 19 and 20 are flowcharts representative of example processes that may be executed by, for example, a processor to implement the example sampling control module of FIG. 8.
Figure 19:
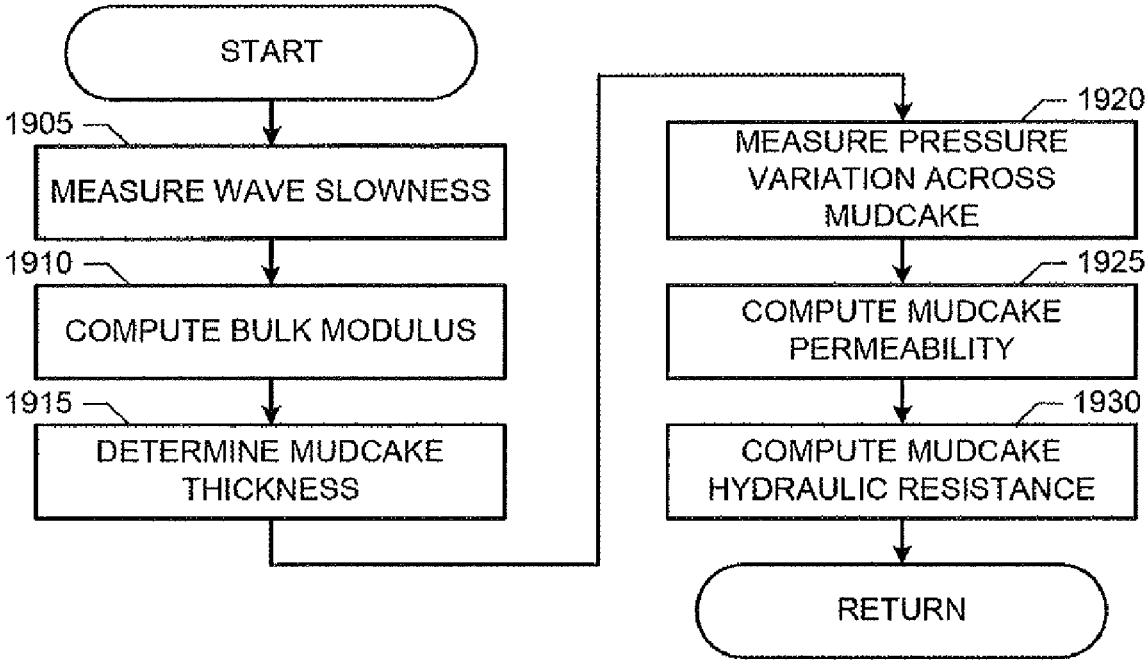
Figure 20:
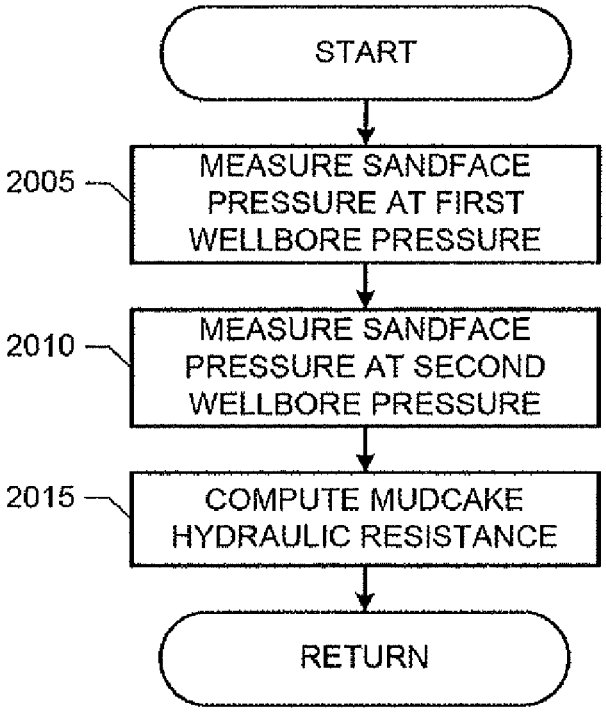

FIGS. 18, 19 and 20 illustrate example processes that may be carried out to implement any or all of the example sampling control modules described herein. The example processes of FIGS. 18, 19 and/or 20 may be carried out by a processor, a controller and/or any other suitable processing device. For example, the processes of FIGS. 18, 19 and/or 20 may be embodied in coded instructions stored on a tangible medium such as a flash memory, a read-only memory (ROM) and/or random-access memory (RAM) associated with a processor (e.g., the example processor P105 discussed below in connection with FIG. 21). Alternatively, some or all of the example processes of FIGS. 18, 19 and/or 20 may be implemented using any combination(s) of circuit(s), ASIC(s), PLD(s), FPLD(s), discrete logic, hardware, firmware, etc. Also, some or all of the example processes of FIGS. 18, 19 and/or 20 may be implemented manually or as any combination of any of the foregoing techniques, for example, any combination of firmware, software, discrete logic and/or hardware. Further, although the example operations of FIGS. 18, 19 and 20 are described with reference to the flowcharts of FIGS. 18, 19 and 20, many other methods of implementing the operations of FIGS. 18, 19 and/or 20 may be employed. For example, the order of execution of the blocks may be changed, and/or one or more of the blocks described may be changed, eliminated, sub-divided, or combined. Additionally, any or all of the example processes of FIGS. 18, 19 and/or 20 may be carried out sequentially and/or carried out in parallel by, for example, separate processing threads, processors, devices, discrete logic, circuits, etc.

The example process of FIG. 18 begins with the example pressure data collector 805 performing a pre-cleanup pressure test (block 1805). The example drawdown pressure estimator 850 estimates a drawdown pressure $\Delta p_E$ that is expected to occur during a cleanup pumpout using, for example, EQN (10) (block 1810). A mudcake hydraulic resistivity $R_m$ is estimated by, for example carrying out the example process of FIG. 19 and/or the example process of FIG. 20 (block 1815).

Using the estimated hydraulic resistivity $R_m$, the example invasion velocity estimator 835 estimates a mud filtrate invasion velocity v through the mudcake leakage using, for example, EQN (1) (block 1820). An estimate of mud filtrate contamination versus virgin formation fluid is then computed using, for example, EQN (8) (block 1825).

If the expected level of contamination $Q_L/Q_p$ is not less than a threshold (block 1830), the sampling tool 510 is repositioned in the wellbore 11 (block 1835) and control returns to block 1805 to perform another pumpout pre-test.

If the expected level of contamination $Q_L/Q_p$ is less than the threshold (block 1830), the example sampling decision logic 860 initiates a pumpout cleanup process (block 1840). The example pressure data collector 805 measures the actual drawdown pressure $\Delta p_{actual}$ (block 1845). The example optical density measurer 806 measures an initial optical density (block 1850).

If a difference between the estimated and actual drawdown pressures is not less than a threshold (block 1855), the sampling tool 510 is repositioned in the wellbore 11 (block 1835) and control returns to block 1805 to perform another pumpout pre-test.

If the difference between the estimated and actual drawdown pressures is less than the threshold (block 1855), the sampling tool 510 continues the pumpout cleanup operation for a specified period of time (block 1860). The optical density measurer 806 then measures another optical density (block 1865).

If a sufficient change in optical density has not occurred (block 1870), the sampling tool 510 is repositioned in the wellbore 11 (block 1835) and control returns to block 1805 to perform another pumpout pre-test. Additionally or alternatively, a cleanup trend may be analyzed (see FIGS. 9 and 10) and mudcake leakage inferred from the same. For example, a reversal in clean-up trend may indicate high mudcake leakage.

If a sufficient optical density change has occurred (block 1870), the sampling tool 510 collects one or more formation fluid samples (block 1875). The sampling tool 510 is then repositioned in the wellbore 11 (block 1835) and control returns to block 1805 to perform another pumpout pre-test.

The example process of FIG. 19 may be carried out to estimate a mudcake hydraulic resistance $R_m$. The example transmitter 1605 and the example receivers 1610 and 1611 of FIG. 1 perform a first ultrasonic measurement using oblique waves to determine compressional and/or shear wave slownesses (or velocities) of the mudcake 205 (block 1905). Using the measured slownesses, the bulk modulus $B_m$ is computed using, for example, EQN (12), assuming a mudcake density ρ (1910). The example mudcake thickness measurer 810 determines the thickness 6 of the mudcake 205 (block 1915). For example, the example sensor 1630 can be used to perform a second ultrasonic measurement using non-oblique (i.e., normal) wave to measure the propagation time $\Delta t$ of an ultrasonic wave through the mudcake 205. As described above, the propagation time $\Delta t$ and the compressional wave velocity $v_p$ can be used to determine the mudcake thickness $\delta$. The example pressure variation measurer 815 measures a pressure variation (e.g., $\Delta p$ and $\Delta t$) across the mudcake 205 (block 1920) and the example permeability estimator 830 estimates a mudcake permeability $k_m$ (or a filtrate mobility $k_m/\mu_f$) based on the measured pressure variation (block 1925). For example, the low frequency measurement described above in connection with FIGS. 13-15 and the calculated mudcake thickness 6 can be used to compute the pressure diffusivity using, for example, the left portion of EQN (4).

$$\eta_m = \frac{\omega}{2}\left(\frac{\delta}{\alpha}\right)^2, \qquad \text{EQN (14)}$$

where, the phase shift $\alpha$ can be computed as $\alpha=\omega\Delta t$, where $\omega$ is the frequency of the pressure wave generated in the formation by the pressure oscillation or pressure pulsing device 1405, $\Delta t$ the measured time variation (FIG. 15 bottom), and $\delta$ is the thickness of the mudcake 205, determined earlier with the second ultrasonic measurement.

Using the bulk modulus $B_m$ determined, for example, using EQN (12), and an assumed porosity $\Phi_m$ (related to assumed density $\rho$), the filtrate mobility can be computed using, for example, the right portion EQN (4).

$$\frac{k_m}{\mu_f} = \eta_m \frac{\phi_m}{B_m} \qquad \text{EQN (15)}$$

The example hydraulic resistance estimator 825 computes a mudcake hydraulic resistance $R_m$ using, for example, EQN (3) (block 1930). Control then returns from the example process of FIG. 19 to, for example, block 1820 of FIG. 18.

The example process of FIG. 20 is another process that may be carried out to estimate a mudcake hydraulic resistance $R_m$. The example process of FIG. 20 begins with the example pressure data collector 805 measuring a first sandface pressure $p_{SF1}$ at a first wellbore pressure $p_{W1}$ (block 2005) using a pretest (such as shown in FIG. 11). The pressure data collector 805 then measures a second sandface pressure $p_{SF2}$ at a second wellbore pressure $p_{W2}$ (block 2010) using a pretest. The example hydraulic resistance estimator 825 computes a mudcake hydraulic resistance $R_m$ using, for example, EQN (2) (block 2015). When EQN (2) is used, the formation hydraulic resistance $R_m$ is assumed, or estimated from at least one of the two pretests, for example using one of the drawdown mobilities $k_D/\mu$ associated with one of the pretests. Control then returns from the example process of FIG. 20 to, for example, block 1820 of FIG. 18.

Figure 21:
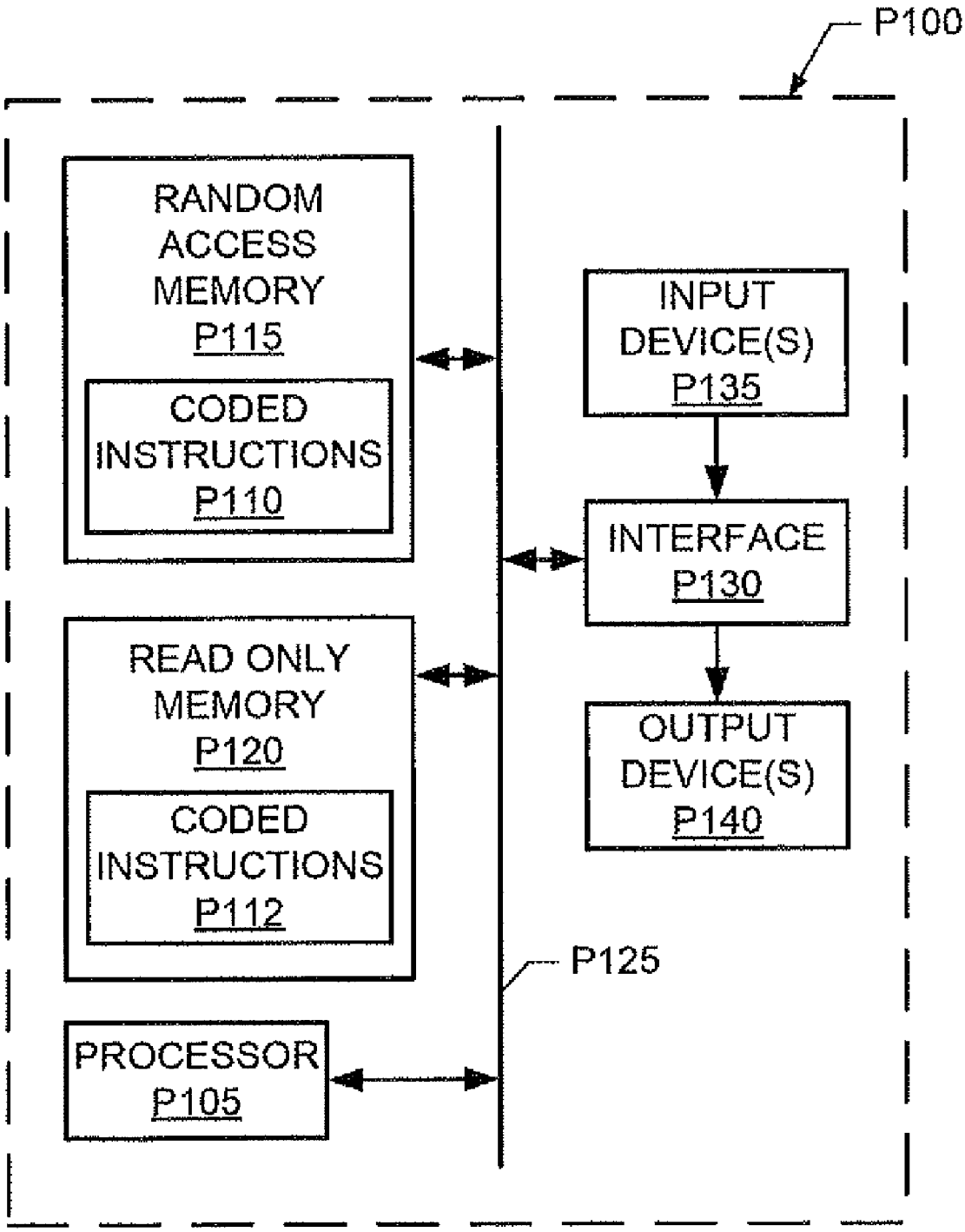
FIG. 21 is a schematic illustration of an example processor platform that may be used and/or programmed to carry out the example processes of FIGS. 18, 19 and/or 20 to implement any of all of the example methods and apparatus described herein.

FIG. 21 is a schematic diagram of an example processor platform P100 that may be used and/or programmed to implement all or a portion of any or all of the example measuring modules 805-807, the example mudcake thickness measurer 810, the example pressure variation measurer 815, the example mudcake quality estimator 820, the example hydraulic resistance estimator 825, the example permeability estimator 830, the example invasion velocity estimator 840, the example leakage estimator 850, the example drawdown pressure estimator 850, the example sampling decision logic 860 and/or, more generally, the example sampling control modules disclosed herein. For example, the processor platform P100 can be implemented by one or more general purpose processors, processor cores, microcontrollers, etc.

The processor platform P100 of the example of FIG. 21 includes at least one general purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example processes of FIG. 18, 19 and/or 20 to implement the example methods and apparatus described herein.

The processor P105 is in communication with the main memory (including a ROM P120 and/or the RAM P115) via a bus P125, The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general purpose input/output, etc. One or more input devices P135 and one or more output devices P140 are connected to the interface circuit P130.

Although certain example methods, apparatus and articles of manufacture have been described herein, the scope of coverage of this patent is not limited thereto. On the contrary, this patent covers all methods, apparatus and articles of manufacture fairly failing within the scope of the appended claims either literally or under the doctrine of equivalents.

What is claimed is:

1. A method, comprising:

positioning a downhole apparatus proximate a mudcake layer formed on a wall of a wellbore penetrating a subterranean formation, wherein the downhole apparatus is configured to perform a formation testing operation;

initiating the formation testing operation;

measuring a downhole property using the downhole apparatus;

determining a value representative of an estimated leakage through the mudcake layer based on the property; and determining, based on the value, whether to terminate the formation testing operation.

2. A method as defined in claim 1, further comprising terminating the formation testing operation when the value does not represent a reduction in formation fluid contamination caused by mud filtrate.

3. A method as defined in claim 1, wherein the downhole property comprises an actual drawdown pressure and wherein determining the value representative of the estimated leakage through the mudcake layer based on the property comprises:

performing a formation pressure test;

determining an estimated drawdown pressure based on a result of the formation pressure test and an actual fluid pumping rate; and computing a difference between the actual drawdown pressure and the estimated drawdown pressure.

4. A method as defined in claim 1, wherein determining the value representative of the estimated leakage through the mudcake layer comprises estimating a value indicative of a reduction in formation fluid contamination caused by mud filtrate, and wherein measuring the downhole property comprises:

measuring a first fluid property of a first sampled fluid at a first time;

measuring a second fluid property of a second sample fluid at a second time; and estimating the reduction in formation fluid contamination from the first and second fluid properties.

5. A method as defined in claim 1, further comprising:

repositioning the downhole apparatus at a second location in the wellbore when the value representative of an estimated leakage indicates that the formation testing operation is to be terminated;

measuring a second downhole property at the second location;

determining a second value representative of a second estimated leakage through the mudcake layer at the second location based on the second property; and determining based on the second value whether to initiate a second testing operation at the second location.

6. A method as defined in claim 1, wherein determining the value representative of the estimated leakage through the mudcake layer comprises determining at least one of a mudcake hydraulic resistance and a filtrate invasion velocity.

7. A method as defined in claim 6, wherein determining the at least one of mudcake hydraulic resistance and filtrate invasion velocity comprises:

measuring a sandface pressure;

measuring a wellbore pressure; and estimating the at least one of mudcake hydraulic resistance and filtrate invasion velocity based on the sandface pressure and the wellbore pressure.

8. A method as defined in claim 6, wherein determining the at least one of mudcake hydraulic resistance and filtrate invasion velocity comprises:

determining a mudcake thickness;

determining at least one of a pressure diffusivity through the mudcake layer, a mudcake permeability and a filtrate mobility through the mudcake; and estimating the at least one of mudcake hydraulic resistance and filtrate invasion velocity based on the mudcake thickness and the at least one of pressure diffusivity, mudcake permeability and filtrate mobility.

9. A method as defined in claim 8, wherein determining the at least one of pressure diffusivity, mudcake permeability and filtrate mobility comprises:

transmitting a low-frequency pressure wave into the formation;

measuring a pressure variation through the mudcake layer;

estimating the at least one of pressure diffusivity, mudcake permeability and filtrate mobility based on the pressure variation and a pressure diffusivity model of the mudcake layer.

10. A method, comprising:

disposing a downhole apparatus proximate a mudcake layer formed on a wall of a wellbore penetrating a subterranean formation;

measuring a downhole property using the downhole apparatus;

determining a value representative of an estimated leakage through the mudcake layer based on the property; and executing a modification of a formation testing operation based on the determined value, wherein the downhole apparatus is configured to perform the formation testing operation, and wherein the modification is selected from the group consisting of:

terminating the formation testing operation; and initiating the formation testing operation.

11. The method of claim 10 further comprising:

performing a formation pressure test with the downhole apparatus;

determining an estimated drawdown pressure based on a result of the formation pressure test and an actual fluid pumping rate of the downhole apparatus;

measuring an actual drawdown pressure during a sampling operation using the downhole apparatus; and determining whether to continue the sampling operation based on the estimated and actual drawdown pressures.

12. The method of claim 10 wherein executing the modification based on the determined value comprises comparing the determined value to a pumpout rate of the downhole apparatus.

13. The method of claim 10 further comprising:

performing a sampling operation, including:

obtaining a first fluid sample at a first time using the downhole apparatus;

measuring a first fluid property of the first fluid sample using the downhole apparatus;

obtaining a second fluid sample at a second time using the downhole apparatus; and measuring a second fluid property of the second fluid sample using the downhole apparatus;

comparing the first and second fluid properties; and terminating the sampling operation based on the comparison.

14. The method of claim 10 wherein the downhole property comprises a sandface pressure, and wherein determining the value representative of the estimated leakage through the mudcake layer based on the property comprises:

measuring a wellbore pressure; and determining a value indicative of a mudcake hydraulic resistance based on the sandface pressure and the wellbore pressure.

15. The method of claim 10 wherein the downhole property comprises a mudcake thickness, and wherein determining the value representative of the estimated leakage through the mudcake layer based on the property comprises:

determining at least one of a pressure diffusivity through the mudcake layer, a mudcake permeability, and a filtrate mobility through the mudcake; and estimating a value indicative of a mudcake hydraulic resistance based on the mudcake thickness and the at least one of pressure diffusivity, mudcake permeability, and filtrate mobility.

16. The method of claim 10 wherein the downhole property comprises at least one of a pressure diffusivity through the mudcake layer, a mudcake permeability, and a filtrate mobility through the mudcake, and wherein determining the value representative of the estimated leakage through the mudcake layer based on the property comprises:

determining a mudcake thickness; and estimating a value indicative of a mudcake hydraulic resistance based on the mudcake thickness and the at least one of pressure diffusivity, mudcake permeability, and filtrate mobility.

17. The method of claim 10 further comprising:

obtaining a first fluid sample at a first time using the downhole apparatus;

measuring a first fluid property of the first fluid sample using the downhole apparatus;

determining a first pumpout volume at the first time;

obtaining a second fluid sample at a second time using the downhole apparatus;

measuring a second fluid property of the second fluid sample using the downhole apparatus;

determining a second pumpout volume at the second time;

estimating first and second formation fluid contamination levels caused by mud filtrate based on the first and second fluid properties; and determining a value indicative of a filtrate invasion velocity based on the first and second pumpout volumes and the first and second contamination levels.

18. The method of claim 10 wherein measuring the downhole property comprises:

transmitting a low-frequency pressure wave into the formation using the downhole apparatus;

measuring a pressure variation through the mudcake layer using the downhole apparatus; and determining a value indicative of at least one of pressure diffusivity, mudcake permeability, and filtrate mobility based on the pressure variation and a pressure diffusivity model of the mudcake layer.

19. The method of claim 10 further comprising:

performing a formation pressure test with the downhole apparatus;

determining an estimated drawdown pressure based on a result of the formation pressure test and an actual fluid pumping rate of the downhole apparatus;

measuring an actual drawdown pressure during a sampling operation using the downhole apparatus;

determining whether to continue the sampling operation based on the estimated and actual drawdown pressures;

obtaining a first fluid sample at a first time using the downhole apparatus;

measuring a first fluid property of the first fluid sample using the downhole apparatus;

determining a first pumpout volume at the first time;

obtaining a second fluid sample at a second time using the downhole apparatus;

measuring a second fluid property of the second fluid sample using the downhole apparatus; and determining a second pumpout volume at the second time;

wherein the downhole property comprises at least one of a pressure diffusivity through the mudcake layer, a mudcake permeability, and a filtrate mobility through the mudcake, and wherein determining the value representative of the estimated leakage through the mudcake layer based on the property comprises determining a mudcake thickness and estimating a value indicative of a mudcake hydraulic resistance based on the mudcake thickness and the at least one of pressure diffusivity, mudcake permeability, and filtrate mobility.

20. A method, comprising:

positioning a downhole apparatus proximate a mudcake layer formed on a wall of a wellbore penetrating a subterranean formation, wherein the downhole apparatus is configured to perform a formation testing operation;

initiating the formation testing operation;

measuring a downhole property using the downhole apparatus;

determining a value representative of an estimated leakage through the mudcake layer based on the property;

determining, based on the value, whether to terminate the formation testing operation; and terminating the formation testing operation when the value does not represent a reduction in formation fluid contamination caused by mud filtrate;

wherein determining the value representative of the estimated leakage through the mudcake layer comprises determining at least one of a mudcake hydraulic resistance and a filtrate invasion velocity, and wherein determining the at least one of mudcake hydraulic resistance and filtrate invasion velocity comprises:

determining a mudcake thickness;

determining at least one of a pressure diffusivity through the mudcake layer, a mudcake permeability and a filtrate mobility through the mudcake; and estimating the at least one of mudcake hydraulic resistance and filtrate invasion velocity based on the mudcake thickness and the at least one of pressure diffusivity, mudcake permeability and filtrate mobility.

21. A method as defined in claim 20, wherein determining the at least one of pressure diffusivity, mudcake permeability and filtrate mobility comprises:

transmitting a low-frequency pressure wave into the formation;

measuring a pressure variation through the mudcake layer;

estimating the at least one of pressure diffusivity, mudcake permeability and filtrate mobility based on the pressure variation and a pressure diffusivity model of the mudcake layer.

22. A method as defined in claim 20, further comprising:

repositioning the downhole apparatus at a second location in the wellbore when the value representative of an estimated leakage indicates that the formation testing operation is to be terminated;

measuring a second downhole property at the second location;

determining a second value representative of a second estimated leakage through the mudcake layer at the second location based on the second property; and determining based on the second value whether to initiate a second testing operation at the second location.

* * * * *